US010369442B1

(12) United States Patent
Stenzler et al.

(10) Patent No.: US 10,369,442 B1
(45) **Date of Patent: *Aug. 6, 2019**

(54) BALL BAT INCLUDING BALL LAUNCH ANGLE BOOSTERS

(71) Applicant: Wilson Sporting Goods Co., Chicago, IL (US)

(72) Inventors: Joshua S. Stenzler, Portland, OR (US); Richard E. Moritz, Portland, OR (US); Brent R. Slater, Vancouver, WA (US); Ty B. Goodwin, Vancouver, WA (US); Mark A. Fritzke, Portland, OR (US); Edwin D. Vander Pol, Beaverton, OR (US); Robert T. Thurman, Plainfield, IL (US); Sean S. Epling, Portland, OR (US); Ryan M. Raagas, Hillboro, OR (US)

(73) Assignee: Wilson Sportings Goods Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/124,674

(22) Filed: Sep. 7, 2018

Related U.S. Application Data

(60) Provisional application No. 62/621,387, filed on Jan. 24, 2018.

(51) Int. Cl.

| | |
|---|---|
| ***A63B 59/58*** | (2015.01) |
| ***A63B 60/42*** | (2015.01) |
| *A63B 102/18* | (2015.01) |
| *A63B 59/51* | (2015.01) |
| *A63B 59/54* | (2015.01) |

(52) U.S. Cl.
CPC ..... *A63B 60/42* (2015.10); *A63B 59/58* (2015.10); *A63B 59/51* (2015.10); *A63B 59/54* (2015.10); *A63B 2102/18* (2015.10)

(58) Field of Classification Search
CPC ..... A63B 59/50; A63B 59/51; A63B 59/54
USPC ..... 473/457, 519, 520, 564–568
See application file for complete search history.

(56) References Cited

U.S. PATENT DOCUMENTS

| | | | | |
|---|---|---|---|---|
| 2,340,156 | A | 1/1944 | Taylor et al. | |
| 3,963,239 | A * | 6/1976 | Fujii | A63B 59/50 473/519 |
| 4,025,377 | A | 5/1977 | Tanikawa | |
| 5,094,453 | A | 3/1992 | Douglas et al. | |
| 5,303,917 | A | 4/1994 | Uke | |
| 5,899,823 | A | 5/1999 | Eggiman | |
| 5,961,405 | A | 10/1999 | MacKay, Jr. | |
| 6,139,451 | A | 10/2000 | Hillerich, III et al. | |
| D482,749 | S | 11/2003 | Gumpel | |
| 6,733,404 | B2 | 5/2004 | Fritzke et al. | |
| 6,949,038 | B2 | 9/2005 | Fritzke | |
| 7,011,588 | B2 | 3/2006 | Fritzke et al. | |
| 7,175,552 | B2 | 2/2007 | Fritzke et al. | |
| 7,207,907 | B2 | 4/2007 | Guenther et al. | |

(Continued)

*Primary Examiner* — Mark S Graham
(74) *Attorney, Agent, or Firm* — Terence P. O'Brien; Todd A. Rothe

(57) ABSTRACT

A ball bat including one of a left-hand configuration designated for a left-handed batter and a right hand configuration designated for a right-handed batter. The left hand configuration is different than the right hand configuration. The ball bat further includes one of a left-hand indicia indicating the left hand configuration and a right hand indicia indicating the right hand configuration.

17 Claims, 24 Drawing Sheets

(56) References Cited

U.S. PATENT DOCUMENTS

| | | | | |
|---|---|---|---|---|
| 7,214,152 | B1 | 5/2007 | Vacek et al. | |
| 7,361,106 | B1 | 4/2008 | Vacek et al. | |
| 7,377,867 | B1 | 5/2008 | Vacek et al. | |
| 7,534,180 | B1 | 5/2009 | Vacek et al. | |
| 7,611,428 | B2 | 11/2009 | Mathew et al. | |
| 7,749,115 | B1 | 7/2010 | Cruz et al. | |
| 7,874,946 | B2 | 1/2011 | Smith | |
| 8,197,366 | B2 | 6/2012 | Chauvin et al. | |
| 8,506,429 | B2 | 8/2013 | Chauvin et al. | |
| 8,512,175 | B2 | 8/2013 | Epling et al. | |
| 8,591,357 | B1 * | 11/2013 | Bonds | A63B 60/10 473/564 |
| 8,602,924 | B2 | 12/2013 | Shindome et al. | |
| 8,708,845 | B2 | 4/2014 | Chuang et al. | |
| 8,852,037 | B2 | 10/2014 | Epling et al. | |
| 8,979,682 | B2 | 3/2015 | Chuang et al. | |
| 9,067,109 | B2 | 6/2015 | Epling et al. | |
| 9,211,460 | B2 | 12/2015 | Slater et al. | |
| 9,242,155 | B1 * | 1/2016 | Lindsay | A63B 59/06 |
| 9,415,284 | B1 * | 8/2016 | Williamson | A63B 59/52 |
| 2004/0038758 | A1 * | 2/2004 | Guenther | A63B 60/00 473/457 |
| 2006/0211522 | A1 * | 9/2006 | Hapanowicz | A63B 69/0002 473/452 |
| 2009/0215559 | A1 * | 8/2009 | McNamee | A63B 59/50 473/567 |
| 2012/0231904 | A1 | 9/2012 | Fonte | |
| 2013/0316859 | A1 * | 11/2013 | Burger | A63B 60/08 473/564 |
| 2014/0235378 | A1 * | 8/2014 | Albin | A63B 59/51 473/564 |
| 2018/0021646 | A1 | 1/2018 | O'Hara et al. | |
| 2018/0345103 | A1 | 12/2018 | McLeod | |

* cited by examiner

200

| STOCK VBC | DISTANCE (FT) | | | | | | | | | | | | | | | | |
|---|---|---|---|---|---|---|---|---|---|---|---|---|---|---|---|---|---|
| LA CATEGORY | LOW LA (15-22.5 DEG) | | | | | MID LA (25-30 DEG) | | | | | | HIGH LA (32.5-40 DEG) | | | | | |
| EXIT VELO (MPH) | 100 | | | | | 95 | | | | | | | | 90 | | | |
| BACKSPIN (RPM) | 1000 | 1100 | 1200 | 1300 | 1400 | 1500 | 1600 | 1700 | 1800 | 1900 | 2000 | 2100 | 2200 | 2300 | 2400 | 2500 | 2600 |
| 15 | 307.8 | 312.2 | 316.2 | 320 | 323.5 | | | | | | | | | | | | |
| 17.5 | 326.9 | 330.9 | 334.6 | 337.9 | 341 | | | | | | | | | | | | |
| 20 | 342.3 | 345.9 | 349.1 | 352.1 | 354.8 | | | | | | | | | | | | |
| 22.5 | 354.4 | 357.5 | 360.3 | 362.9 | 365.2 | | | | | | | | | | | | |
| 25 | | | | | | 374.3 | 348.8 | 350.1 | 351.2 | 352.2 | 353.1 | | | | | | |
| 27.5 | | | | | | | 353.2 | 354.2 | 355 | 355.8 | 356.5 | | | | | | |
| 30 | | | | | | | 355.2 | 355.9 | 356.5 | 357 | 357.4 | | | | | | |
| 32.5 | | | | | | | | | | | | 356.3 | 356.4 | 331.3 | 331.3 | 331.2 | 331.1 |
| 35 | | | | | | | | | | | | 352.8 | 352.7 | 328.3 | 328.1 | 327.9 | 327.7 |
| 37.5 | | | | | | | | | | | | | | 323.4 | 323.1 | 322.9 | 322.4 |
| 40 | | | | | | | | | | | | | | 316.7 | 316.3 | 315.9 | 315.4 |

202

| GATTACA | DISTANCE (FT) | | | | | | | | | | | | | | | | |
|---|---|---|---|---|---|---|---|---|---|---|---|---|---|---|---|---|---|
| LA ADDERS | LOW LA-RPM + 150 RPM/VELO + 2 MPH | | | | | MID LA-RPM + 100 RPM/VELO + 2 MPH | | | | | | HIGH LA-RPM + 75 RPM/VELO + 2 MPH | | | | | |
| EXIT VELO (MPH) | 102 | | | | | 97 | | | | | | | | 92 | | | |
| BACKSPIN (RPM) | 1150 | 1250 | 1350 | 1450 | 1550 | 1600 | 1700 | 1800 | 1900 | 2000 | 2100 | 2175 | 2275 | 2375 | 2475 | 2575 | 2675 |
| 15 | 324.6 | 328.7 | 332.5 | 336 | 339.2 | | | | | | | | | | | | |
| 17.5 | 343.4 | 347 | 350.4 | 353.4 | 356.3 | | | | | | | | | | | | |
| 20 | 358.2 | 361.4 | 364.4 | 367 | 369.5 | | | | | | | | | | | | |
| 22.5 | 369.7 | 372.4 | 374.9 | 377.2 | 379.3 | | | | | | | | | | | | |
| 25 | | | | | | 386.8 | 360.9 | 362.1 | 363.1 | 364 | 364.8 | | | | | | |
| 27.5 | | | | | | | 364.8 | 365.7 | 366.5 | 367.1 | 367.7 | | | | | | |
| 30 | | | | | | | 366.3 | 366.9 | 367.4 | 367.9 | 368.2 | | | | | | |
| 32.5 | | | | | | | | | | | | 366.5 | 366.5 | 341.3 | 341.2 | 341.2 | 341 |
| 35 | | | | | | | | | | | | 362.5 | 362.3 | 337.8 | 337.6 | 337.4 | 337.1 |
| 37.5 | | | | | | | | | | | | | | 332.5 | 332.1 | 331.7 | 331.3 |
| 40 | | | | | | | | | | | | | | 325.3 | 324.8 | 324.3 | 323.8 |

FIG. 12

204

| EXIT VELVO - 96 MPH | STOCK VBC VS. GTC - DISTANCE DELTA (FT) | | | | | | | | | | | | | | | | | AVE DELTA (FT) |
|---|---|---|---|---|---|---|---|---|---|---|---|---|---|---|---|---|---|---|
| 15 | 16.8 | 16.5 | 16.3 | 16 | 15.7 | | | | | | | | | | | | | |
| 17.5 | 16.5 | 16.1 | 15.8 | 15.5 | 15.3 | | | | | | | | | | | | | |
| 20 | 15.9 | 15.5 | 15.3 | 14.9 | 14.7 | | | | | | | | | | | | | |
| 22.5 | 15.3 | 14.9 | 14.6 | 14.3 | 14.1 | | | | | | | | | | | | | 15.5 |
| 25 | | | | | | 12.5 | 12.1 | 12 | 11.9 | 11.8 | 11.7 | | | | | | | |
| 27.5 | | | | | | | 11.6 | 11.5 | 11.5 | 11.3 | 11.2 | | | | | | | |
| 30 | | | | | | | 11.1 | 11 | 10.9 | 10.9 | 10.8 | | | | | | | 11.5 |
| 32.5 | | | | | | | | | | | | 10.2 | 10.1 | 10 | 9.9 | 9.9 | 9.9 | |
| 35 | | | | | | | | | | | | 9.7 | 9.6 | 9.5 | 9.5 | 9.5 | 9.4 | |
| 37.5 | | | | | | | | | | | | | | 9.1 | 9 | 8.9 | 8.9 | |
| 40 | | | | | | | | | | | | | | 8.6 | 8.5 | 8.4 | 8.4 | 9.4 |

FIG. 12 CONTINUES

BALL BAT INCLUDING BALL LAUNCH ANGLE BOOSTERS

CROSS REFERENCE TO RELATED APPLICATION

The present application claims priority under 35 U.S.C. § 119 from U.S. Provisional Patent Application Ser. No. 62/621,387 filed on Jan. 24, 2018 by Stenzler et al. and entitled BALL BAT INCLUDING BALL SPIN ENHANCING STRUCTURE, the full disclosure of which is hereby incorporated by reference. The present application is related to co-pending U.S. patent application Ser. Nos. 16/124,638 and 16/124,710 filed on the same day herewith, the full disclosure of which is hereby incorporated by reference.

BACKGROUND

Ball bats are well known and typically include a handle portion, a barrel or hitting portion. Ball bats can be formed as a one-piece body with the handle portion integrally formed with the barrel portion, or as a multi-piece body in which the handle portion is formed separately from the barrel portion and are connected either directly or indirectly with one or more intermediate elements. The materials used to form bats have changed and become more varied overtime, including materials such as wood, aluminum, other alloys, fiber composite materials and combinations thereof. In many instances, the incorporation of new materials and compositions for ball bats has led to increased durability, reliability and performance. The new materials and compositions have also increased the number of bat configurations and choices available to ball players. Still further, the number of baseball and/or softball organizations has also increased over time. Such baseball and softball organizations periodically publish and update equipment standards and/or requirements including performance limitations for ball bats.

Performance limitations placed on to ball bats are often targeted toward reducing the maximum coefficient of restitution (COR) a ball bat provides when impacted with a ball. With such limitations, bat manufacturers are continually looking for bat constructions that improve the bat performance without exceeding bat COR limitations. Additionally, hitting a baseball or a softball is considered to be one of the more difficult activities in all of sports. Hitting a baseball or softball is considered both an art and a science.

In baseball, extra base hits and home runs are significantly more valuable than singles. So much so that when evaluating hitters, a statistic called "slugging percentage" (total bases divided by at bats) is valued as highly (if not more than) the traditional hitting metrics: batting average, home runs and runs batted in (RBI). Depending on the type of hitter or batter, and game situation, batters often attempt to just make contact with the ball to get a hit, such as a single, but extra bases are always advantageous. There is an ideal launch angle range for batted balls that increases the likelihood of the batted ball resulting in an extra base hit and/or a home run. Typically, this range is from 20-30 degrees with respect to a horizontal plane. Balls hit in this launch angle range do not become low angle line drives and ground balls, and they also don't become very high angle, low velocity pop up and fly outs. Table 1 summarizes home run data from the top 12 home run hitters in the major leagues from the 2015 season to the first half of the 2018 season.

TABLE 1

Table 1. Summary of 250 Farthest MLB Home Runs - 2015-2018 Regular Season (4/16/18) (www.baseballsayant.com)
250 Farthest MLB Home Runs - 2015-2018 Regular Season (6/26/18)

| Launch Angle Range | # of HRs | % of HRs | Ave Launch Angle (deg) | Ave Exit Velocity (mph) | Ave Distance (ft) |
|---|---|---|---|---|---|
| 15-20 | 8 | 3.2 | 18.4 | 115.7 | 462.5 |
| 20.1-25 | 81 | 32.4 | 23.2 | 112.2 | 461.9 |
| 25.1-30 | 134 | 53.6 | 27.3 | 110.6 | 462.7 |
| 30.1-35 | 24 | 9.6 | 31.0 | 109.3 | 462.7 |
| 35.1+ | 2 | 0.8 | 24.4 | 71.8 | 307.0 |

As shown above, 86% of all home runs were hit with launch angles between 20 and 30 degrees and distance was maximized. Exit velocity decreases at a rate of approximately 2 mph per 5 degrees of launch angle from 15-35 degrees. Although balls hit with launch angles greater than 35 degrees had slightly higher exit velocities, average distance and rate of occurrence was the lowest. Also note that out of the 100 farthest hit home runs in the 2015 MLB season, 89 fell in the intermediate launch angle range of 20-30 degrees (Table 2).

TABLE 2

Table 2. Summary of the 100 farthest hit home runs in the 2015 MLB season (www.hittrackeronline.com)

| Launch Angle Range | #of HRs | % of Total HRs | Ave Launch Angle (deg) | Ave Exit Velocity (mph) | Ave Distance (ft) |
|---|---|---|---|---|---|
| 15-20 | 2 | 2 | 18.6 | 116.4 | 444.5 |
| 20.1-25 | 35 | 35 | 23.4 | 112.2 | 451.9 |
| 25.1-30 | 54 | 54 | 27.2 | 110.3 | 451.3 |
| 30.1-35 | 8 | 8 | 31.1 | 110.1 | 449.3 |
| 35.1+ | 1 | 1 | 35.1 | 107.4 | 456.0 |

A recent trend in batting instruction is to encourage batters increase their launch angle when impacting a ball by altering their swing. A ball hit with an increased launch angle can travel further in the air than a ball hit at a lower launch angle, thereby in many instances increasing the likelihood of hitting a home run.

BRIEF DESCRIPTION OF THE DRAWINGS

FIG. 12 is a table of calculated ball flight distances for the bad of FIG. 4 and a similar bat lacking launch angle boosters.

DETAILED DESCRIPTION OF EXAMPLES

Figure 1:
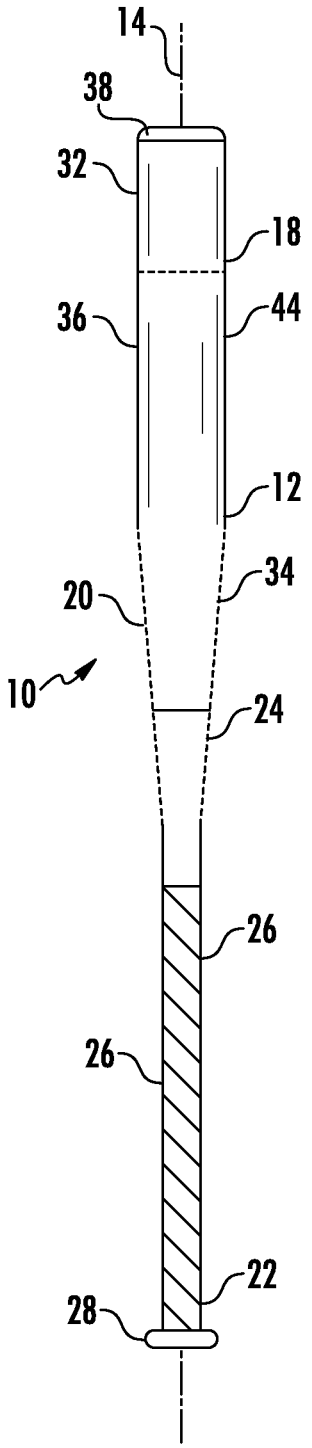
FIG. 1 is a side view of an example ball bat.

Usually when a player hits a ball in the intermediate launch angle range of 20-30 degrees, exit velocity can be compromised (Table 1 and 2). In other words, an increase in launch angle typically results in a sacrifice in exit velocity. Harder hit balls are commonly at lower launch angles because of strong impact quality and high efficiency in the collision between bat and ball.

Disclosed herein are example ball bats that enhance ball flight distance by providing higher launch angles without the typical sacrifice in exit velocity. The disclosed ball bats enable a player to impart more spin on to the ball, increase ball exit velocity and/or increased launch angle without having to adjust their swing mechanics or approach at the plate. As a result, a player can be a more successful hitter and have a higher slugging percentage.

For a given launch angle, the disclosed ball bats enhance exit velocity of the ball, the velocity the ball leaving the bat following impact. For a given swing plane and angle of ball impact, the disclosed ball bats increase the launch angle of the ball. For a given swing plane and angle of ball impact, the disclosed ball bats enhance the backspin. Each of such enhancements increase the ball flight distance since launch angle, exit velocity and ball spin are the 3 main contributing factors to batted ball distance. Importantly, implementations of the present invention do not increase exit velocities at launch angles at or approximately 0 degrees. Accordingly, implementations of the present invention can satisfy bat performance limitations of organized baseball, fastpitch and/or softball organizations, while providing the increased exit velocities for balls impacted at a higher launch angle. Implementations of the present invention, can also satisfy bat performance limitations of organized baseball, fastpitch and/or softball organizations by providing increased launch angles for a given exit velocity for balls impacted at higher launch angles.

The disclosed example ball bats include circumferentially-spaced launch angle boosters along a barrel portion of the bat. A launch angle booster is material or dimensional variation along the barrel portion of the ball bat that generally extends along at least portions of the barrel portion of the ball bat at an angle of at least 3° and no greater than 12° from the longitudinal axis of the bat. The launch angle boosters of the disclosed ball bats especially enhance launch angle, exit velocity and ball spin for swings that would otherwise result in launch angles of between 20° and 30°.

In one implementation, the launch angle boosters comprise circumferentially-spaced grooves. Such grooves or channels may be formed by removing material from the wall of the barrel portion of the bat, adding material to the wall of the barrel portion of the bat or molding otherwise forming the barrel portion of the bat so as to have a thickness variations around the circumference of the barrel which form the spaced grooves. In some implementations, the grooves have a depth of at least 0.001 inches and no greater than 0.0625 inches. In some implementations, the grooves have a longitudinal length (as measured along a line parallel to the longitudinal axis of the bat) of at least 3 inches. In some implementations, the grooves have a longitudinal length of at least 3 inches and no greater than 15 inches. In other implementations, the grooves have a longitudinal length of at least 7 inches and no greater than 11 inches.

In one implementation, launch angle boosters comprise rows of grouped individual variations, wherein the rows extend along the axis at an angle of at least 3° and no greater than 12° from the longitudinal axis. For example, in one implementation, launch angle boosters may comprise groupings of dimples, protuberances and the like which are arranged in the noted rows.

In one implementation, the launch angle boosters may be formed by material variations in the wall of the barrel portion. For example, the wall of the barrel portion may have a uniform thickness along its length, but may comprise first rows or strips of material having a first material property, such as a durometer, and second rows of his or strips of material having a second different corresponding material property, wherein the first and second rows alternate and wherein the first and second rows extend along axes that are at an angle of at least 3° and no greater than 12° from the longitudinal axis of the ball bat. In one implementation, the circumferential thickness of the wall of the barrel portion may be uniform about the longitudinal axis of the bat, wherein different circumferential regions about the axis, such as alternating regions, have different material properties. The different grooves, strips or other structures having different material properties provide the barrel of the bat with a varying stiffness about its circumference.

Disclosed herein is a ball bat for impacting a ball, wherein the bat extends along a longitudinal axis. The ball bat comprises a handle portion and a barrel portion coupled to the handle portion. The barrel portion comprises circumferentially-spaced launch angle boosters. Each of the launch angle boosters extends along the axis at an angle of at least 3° and no greater than 12° from the longitudinal axis.

Disclosed herein is an example ball bat for impacting a ball. The bat extends along a longitudinal axis. The bat may comprise a handle portion of barrel portion coupled to the handle portion. The barrel portion comprises a series of alternating elongate groups. Each of the grooves extend along the axis at an angle of at least 3° and no greater than 12° from the longitudinal axis.

Disclosed is a bat customization method. The bat customization method may comprise capturing images of a batter swing and determining a swing plane angle of the batter swing at ball impact at a middle elevation of a strike zone of the batter based upon the captured images. Such images may be in the form of still images or video/motion images. The method involves providing a bat for the batter, wherein the bat has circumferentially-spaced launch angle boosters. Each of the launch angle boosters extend along the axis at an angle based upon the determined swing plane angle.

FIG. 1 illustrates a ball bat is generally indicated at 10. The ball bat 10 of FIG. 1 is configured as a baseball bat; however, the ball bat 10 can also be formed as a fastpitch softball bat, a slow pitch softball bat, a rubber ball bat, or other form of ball bat. The bat 10 includes a frame 12 extending along a longitudinal axis 14. The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel portion 18 can range from 1.5 to 3.5 inches.

The frame 12 has a relatively small diameter handle portion 16, a relatively larger diameter barrel portion 18 (also referred as a hitting or impact portion), and an intermediate tapered element. In one implementation, the handle and barrel portions 16 and 18 and the intermediate tapered element can be formed as separate structures, which are connected or coupled together. This multi-piece frame construction enables each of the three components to be formed of different materials or similar materials to match a particular player need or application. In another implementation, the frame can be a one piece integral structure that includes the handle portion and the barrel portion.

Handle portion 16 is an elongate tubular structure that extends along the axis 14. The handle portion 16 includes having a proximal end region 22 and a distal end region 24. Preferably, the handle portion 16 is sized for gripping by the user and includes a grip 26, which is wrapped around and extends longitudinally along the handle portion 16, and a knob 28 is connected to the proximal end 22 of the handle portion 16. The distal end region 24 can be coupled to the element or to the barrel portion 18. The handle portion 16 is preferably a cylindrical structure having a uniform outer diameter along its length. The handle portion 16 can also have a uniform inner diameter along its length. In alternative implementations, the handle portion can be formed with a distal end that outwardly extends to form a frustoconical shape or tapered shape.

The handle portion 16 is formed of a strong, generally flexible, lightweight material, preferably a fiber composite material. Alternatively, the handle portion 16 can be formed of other materials such as an aluminum alloy, a titanium alloy, steel, other alloys, a thermoplastic material, a thermoset material, wood or combinations thereof. In other alternative embodiments, the handle can have slightly tapered or non-cylindrical shapes.

As used herein, the terms "composite material" or "fiber composite material" refer to a plurality of fibers impregnated (or permeated throughout) with a resin. In one example embodiment, the fibers can be systematically aligned through the use of one or more creels, and drawn through a die with a resin to produce a pultrusion, as discussed further below. In an alternative example embodiment, the fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly example implementations, the number layers can range from 3 to 8. In other implementations, the number of layers can be greater than 8. In multiple layer constructions, the fibers can be aligned in different directions (or angles) with respect to the longitudinal axis 14 including 0 degrees, 90 degrees and angular positions between 0 to 90 degrees, and/or in braids or weaves from layer to layer. For composite materials formed in a pultrusion process, the angles can range from 0 to 90 degrees. In some implementations, the layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon or thermoplastic materials. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, Kevlar®, Spectra®, poly-para-phenylene-2, 6-benzobisoxazole (PBO), hemp and combinations thereof. In one set of example embodiments, the resin is preferably a thermosetting resin such as epoxy or polyester resins. In other sets of example embodiments, the resin can be a thermoplastic resin. The composite material is typically wrapped about a mandrel and/or a comparable structure (or drawn through a die in pultrusion), and cured under heat and/or pressure. While curing, the resin is configured to flow and fully disperse and impregnate the matrix of fibers.

The barrel portion 18 of the frame 12 is "tubular", "generally tubular", or "substantially tubular", each of these terms is intended to encompass softball style bats having a substantially cylindrical impact (or "barrel") portion as well as baseball style bats having barrel portions with generally frusto-conical characteristics in some locations. Alternatively, other hollow, tubular shapes can also be used. The barrel portion 18 extends along the axis 14 and has an inner surface 32 and an outer surface 34. The barrel portion 18 includes a proximal region 36, a distal region 38 spaced apart by a central region 40. The barrel portion 18 is configured for impacting a ball (not shown), and preferably is formed of a strong, durable and resilient material, such as, an aluminum alloy. In alternative example embodiments, the proximal member 36 can be formed of one or more composite materials, a titanium alloy, a scandium alloy, steel, other alloys, a thermoplastic material, a thermoset material, wood or combinations thereof.

The bat 10 further includes an end cap 30 attached to the distal region 38 of the barrel portion 18 to substantially enclose the distal region 38. In one example embodiment, the end cap 30 is bonded to the distal region 38 through an epoxy. Alternatively, the end cap can be coupled to the distal region through other adhesives, chemical bonding, thermal bonding, an interference fit, other press-fit connections and combinations thereof.

Figure 2:
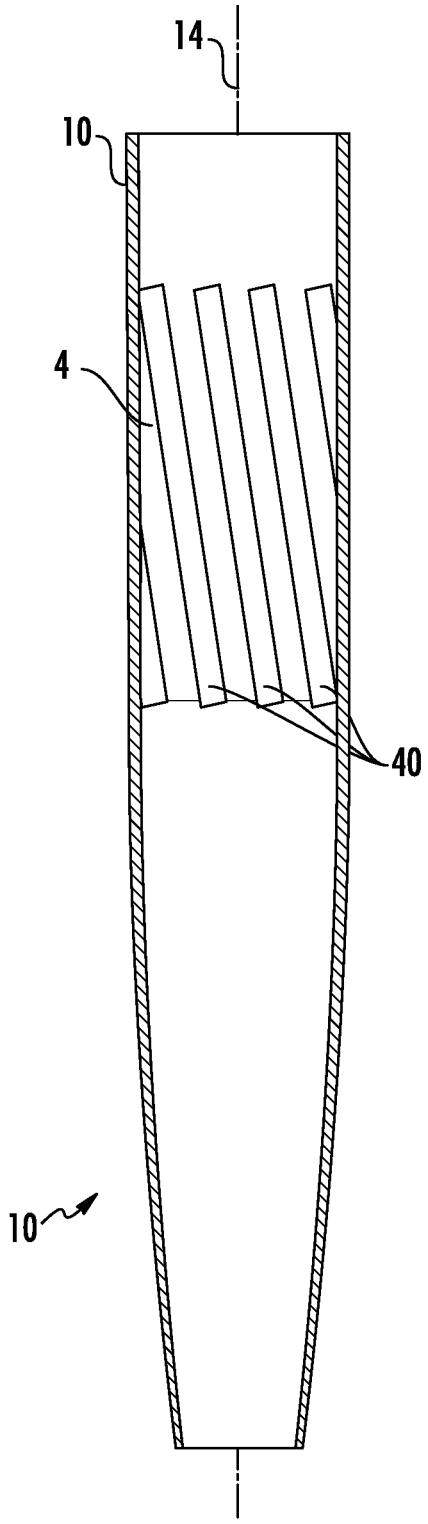
FIG. 2 is a sectional view of portions of the ball bat of FIG. 1.

FIG. 2 is an enlarged sectional view of ball bat 10 illustrating the interior of barrel portion 18. As shown by FIG. 2, the interior of barrel portion 18 comprises a series of circumferentially-spaced launch boosters 40. Launch angle boosters 40 comprise material and/are dimensional variations that generally extend along individual axes or extend in rows that are angularly offset with respect to the longitudinal axis 14. In one implementation, launch angle boosters 40 comprise a series of circumferentially-spaced grooves. In some implementations where boosters 40 are provided by grooves, the grooves may have a depth of at least 0.001 inches and no greater than 0.0625 inches. In another implementation, launch angle boosters 40 comprise a series of circumferentially-spaced ribs or raised bars. In some implementations, the ribs or raised bars have a height or thickness of at least 0.001 inches and no greater than 0.0625 inches. In some implementations, the grooves and/or ribs have a longitudinal length of at least 3 inches. In some implementations, the grooves and/or ribs have a longitudinal length of at least 3 inches and no greater than 15 inches. In other implementations, the grooves and/or ribs have a longitudinal length of at least 7 inches and no greater than 11 inches. In yet another implementation, launch angle boosters 40 comprise a relatively dense arrangement of or grouping of individual material or dimensional variations that are generally arranged along such rows. For example, launch angle boosters 40 may comprise a dense region of individual dimples, pimples, bumps, bars or the like grouped along the rows which extend along the individual axes. In yet another implementation, launch angle boosters 40 may comprise elongate regions formed from a first material or composition of materials, wherein the circumferential spacing between the launch boosters 40 are formed from a second different material or second different composition of materials having different physical properties.

Figure 3A:
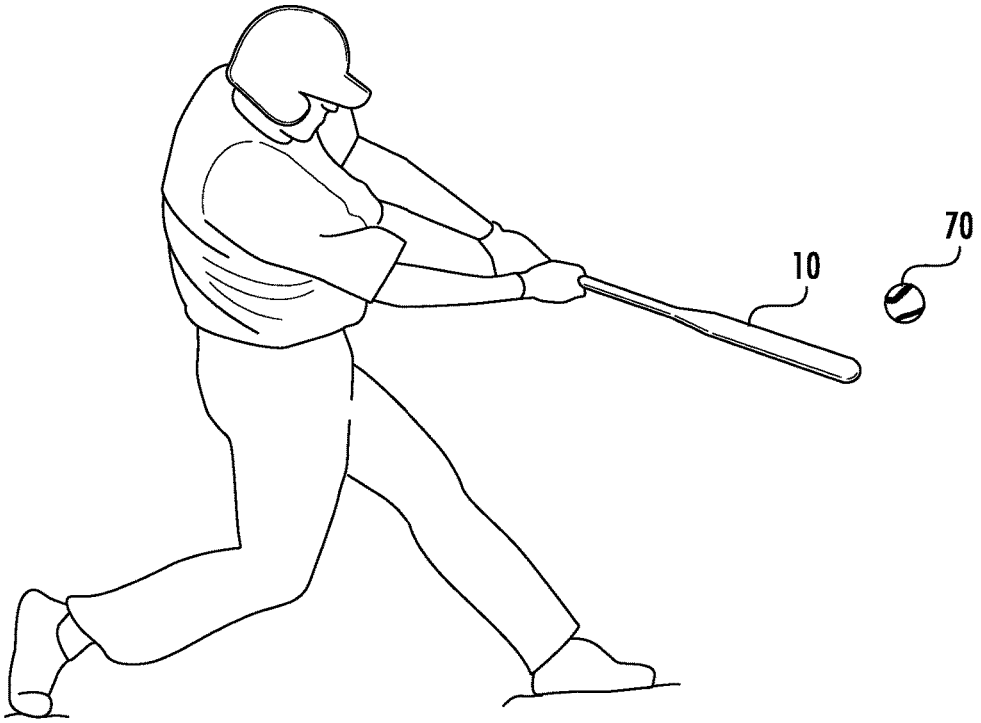
FIG. 3A is a side view illustrating a batter swinging the bat of FIG. 1 at an example ball.
Figure 3B:
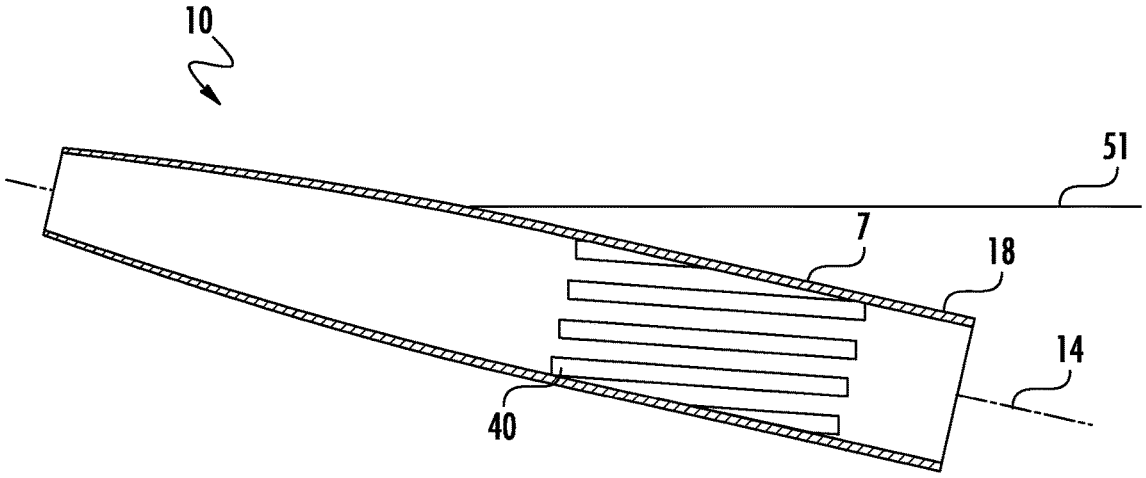
FIG. 3B is a sectional view of portions of the ball bat of FIG. 1 during the swing shown in FIG. 3A.

The individual axes of the launch angle boosters 40 are at an angle of at least 3° and no greater than 12°. This angling of the individual axes of launch angle boosters 40 enhances launch angle, ball exit velocity and/or spin for a given ball impact in a given swing plane as compared to the exact same bat without such angled launch angle boosters 40. The angle of 3 to 12 degrees enables the boosters 40 (in the form of grooves) to be aligned so as to generally parallel with the ground when the bat 10 extends through the hitting zone and impacts the ball. FIG. 3A illustrates an example of a right-handed batter impacting a ball with the bat angled downward with respect to horizontal at angle that is approximately 5 degrees. FIG. 3B is a sectional view of ball bat 10 (shown in large in FIG. 2) illustrated at substantially the same angle (−5°) at which the bat 10 is being swung by the batter in FIG. 3A. As shown by FIG. 3B, the angling of launch angle boosters 40 with respect to longitudinal axis 14 results in launch angle boosters 40 being more closely aligned to the horizon or a horizontal axis 51, more parallel to the ground despite the downward angling of bat 10 during the batter swing. As a ball bat 10 may significantly enhances a combination of the launch angle, the spin rate and the exit velocity of balls.

FIGS. 4, 5A, 6, 7A and 7B illustrate portions of another example ball bat 110. Ball bat 110 is similar to ball bat 10 described above except that ball bat 110 comprises launch angle boosters in the form of grooves 140. Launch angle boosters 140 provide variable circumferential barrel stiffness to help improve exit velocities and possibly spin rates for balls hit at intermediate launch angles (20-30 degrees). In one implementation, the variable circumferential barrel stiffness is achieved by creating longitudinal sections of varying barrel thickness/stiffness in the hitting area around the barrel's circumference.

Figure 5A:
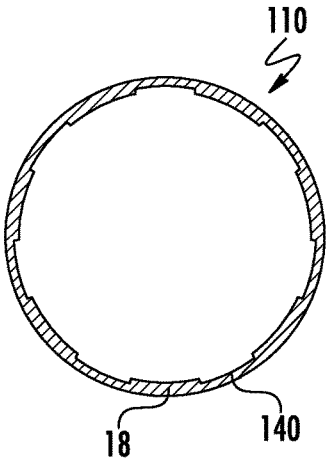
FIG. 5A is a cross-sectional view of the ball bat of FIG. 4.

As shown by FIG. 5A, in one implementation, the barrel portion 18 can be formed of an aluminum alloy and can include internal grooves formed on the inside of the barrel. The number of sections and width can vary. In one implementation, the barrel portion 18 can be formed with a plurality of grooves 140, such as 8 grooves 140 each approximately 0.5 inch wide and spacing the thick and thin areas relatively equally around the circumference of a 2.625 inch diameter bat 10. In some implementations, the grooves 140 have a depth of at least 0.001 inches and no greater than 0.0625 inches. In some implementations, the grooves 140 have a longitudinal length of at least 3 inches. In some implementations, the grooves 140 have a longitudinal length of at least 3 inches and no greater than 15 inches. In other implementations, the grooves 140 have a longitudinal length of at least 7 inches and no greater than 11 inches.

Figure 5B:
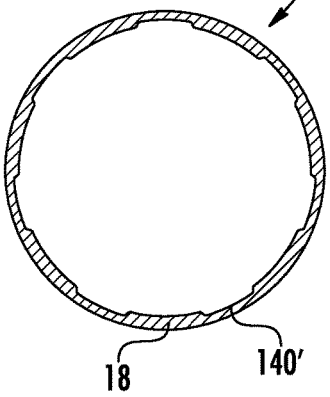
FIG. 5B is a cross-sectional view of an alternative example implementation of the ball bat of FIG. 4.

In the example shown in FIG. 5A, grooves 140 have relatively sharp distinctions or edges. However, as shown by FIG. 5B, such grooves may have gradual transitions with respect to the surrounding interior surfaces. FIG. 5B illustrates ball bat 110'. Ball bat 110' is identical to ball bat 110 except that ball that 110' comprises grooves 140' in place of grooves 140, wherein grooves 140' have gradual or sloped edges.

In one implementation, the grooves 140 may be formed in the barrel portion 18 through a chemical operation, a machining operation or a combination thereof after formation. In another implementation, the grooves 140 may be formed in the barrel portion using CNC mills or lathes, the grooves 140 or flats can be cut on the inside of the barrel. Chemical etching may also be implemented with masking to cut away at the material in a controlled manner. In other implementations, the bat barrel portion 18 can be formed of a fiber composite material with grooves 140.

Most players have swing planes that are not level with respect to the ground when ball impact occurs. In order to specifically target swing planes that generate fly balls where exit velocity is lost and increased backspin is desired, the angle of the thinner sections or locations of the grooves 140 is modified. In one implementation, the grooves 140 can be formed in a helical manner similar to "rifling" so that when impact occurs, the grooves/flats are relatively parallel to the ground, even if the barrel is not. In another implementation, varying angles of the grooves with respect to the longitudinal axis 14 of the bat can be tailored to each individual player's swing plane.

Figure 4:
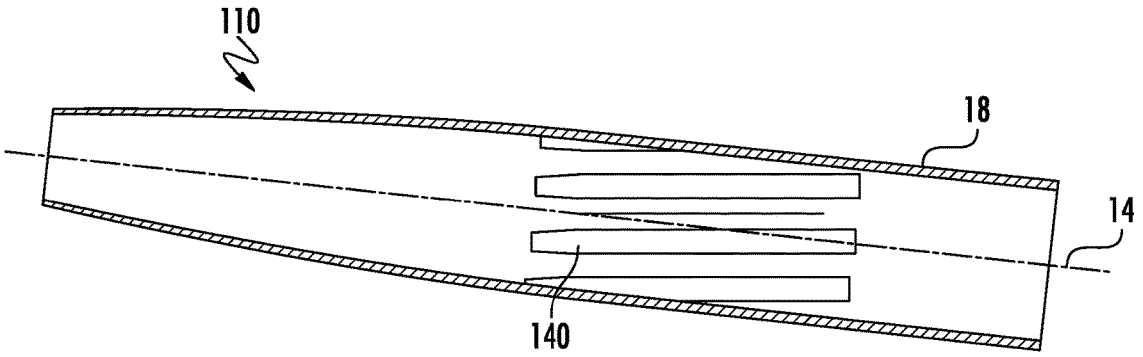
FIG. 4 is a sectional view of portions of an example ball bat.
Figure 6:
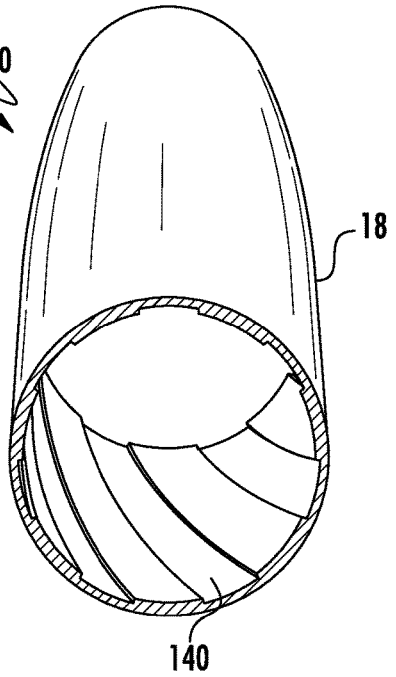
FIG. 6 is a perspective view of the ball bat of FIG. 4 with portions shown in section.

When the grooves 140 are angled within respect to the longitudinal axis within the range of 3 degrees to 12 degrees the bat provides significantly improved performance. In the example illustrated, as shown by FIGS. 4 and 6, grooves 140 extend along an axis 14 at an angle of 5° from the longitudinal axis 14. As a result, ball bat 10 may be well-suited for a right-handed batter having a swing plane results in the ball bat tilted at an angle of approximately 5°.

Figure 7A:
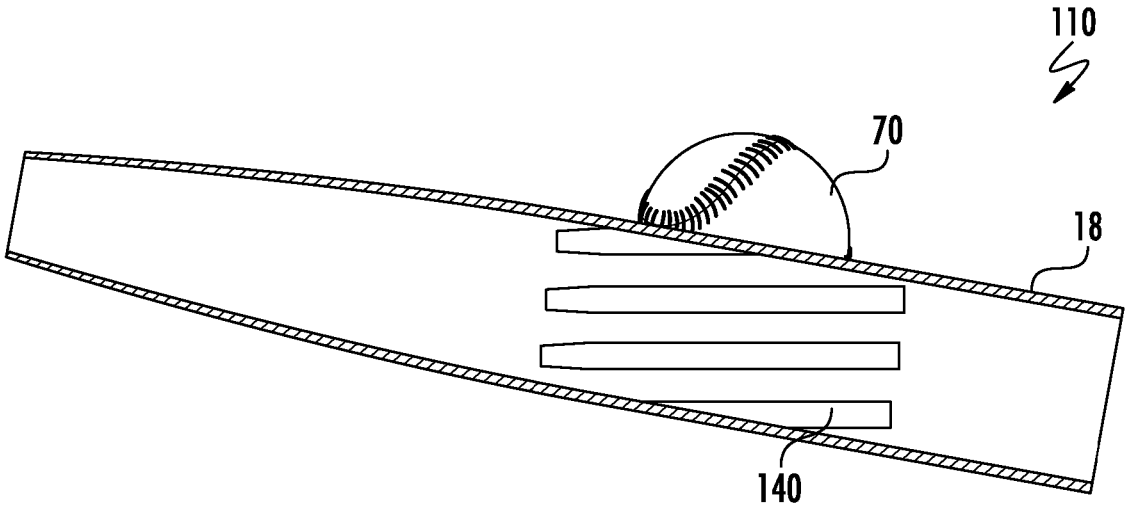
FIG. 7A is a sectional view of the ball bat of FIG. 4 during impact with an example ball.
Figure 7B:
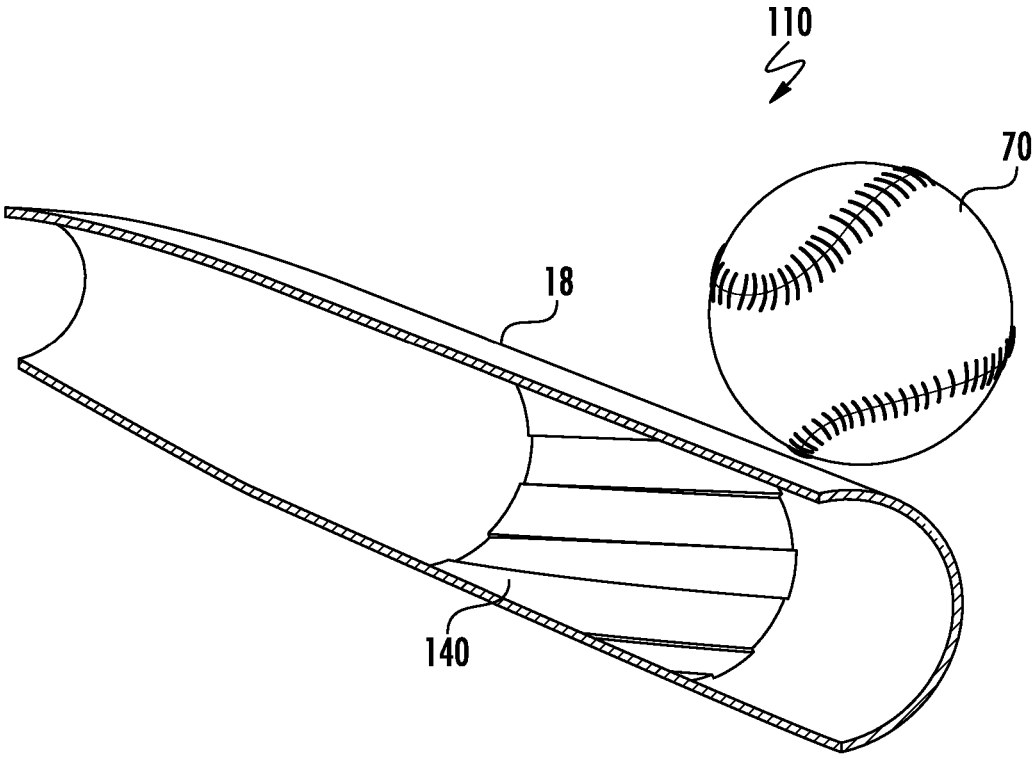
FIG. 7B is a sectional view of the ball bat of FIG. 4 during impact with an example ball.

FIGS. 7A and 7B illustrate that 110 during impact with an example ball 70. As discussed above with respect to FIGS. 3A and 3B, the angling of grooves with respect to the longitudinal axis 14 results in grooves 140 being more parallel to the ground at the point of ball impact. As a result, ball 70 clocks about exterior of bat 110 to a greater extent during ball impact, similar to teeth of a gear contacting in linearly translating past and through a ball). This results in ball 70 leaving that 110 is a greater spin and with enhanced exit velocity for the given launch angle.

Enhanced Spin

Figure 8:
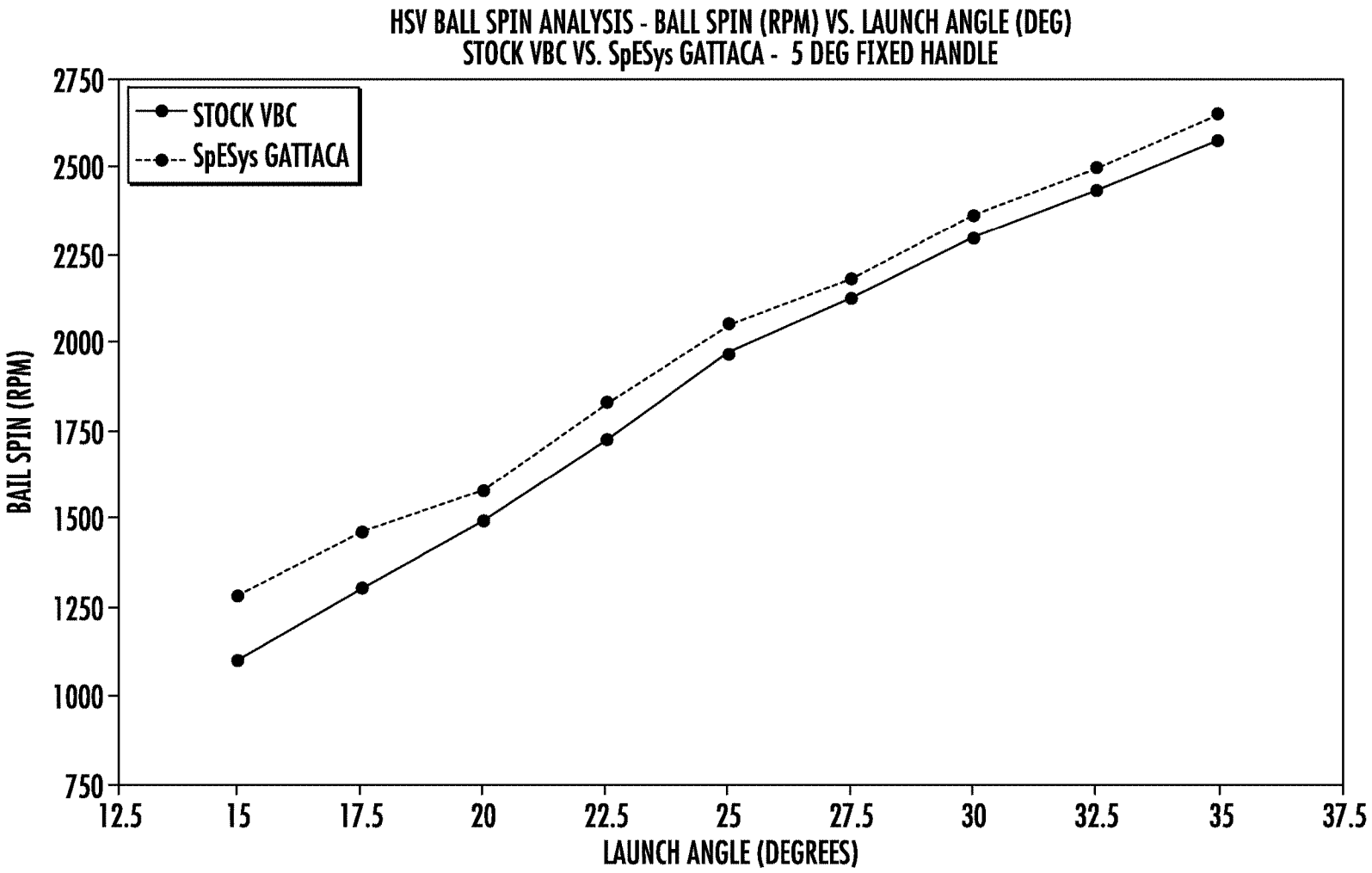
FIG. 8 is a graph comparing ball spin versus launch angle for the bat of FIG. 4 with respect to a similar bat lacking launch angle boosters.

Table 3 below and FIG. 8 illustrate bat test lab results from numerous tests of a ball impacting a bat. The lab results illustrate that a bat configured in accordance with an embodiment of the present application produces or imparts more spin to a baseball than a bat without the variable wall structure of the present application. A stock DeMarini® Voodoo® baseball bat was tested with 100 mph (+/−1 mph) (ball in speed) ball impacts occurring over rebound launch angles of 15 degrees to 35 degrees. The spin rate and launch angle of the ball leaving the bat following impact was also recorded and measured using high speed video and tracking software.

The particular data in Table 3 below and FIG. 8 was acquired by directing a regulation baseball at a ball speed (the velocity of the ball prior to impact with the bat in a horizontal orientation) of 100 mph (+/−1 mph) as measured by light gates, I-beams sensors commercially available from Automated Design Corporation, 1404 Joliet Rd., Romeoville, Ill. 60446. A regulation baseball is a ball that is 9.00-9.25 inches (228.60-234.95 mm) in circumference, (2.86-2.94 in or 72.64-74.68 mm in diameter), and 5.00 to 5.25 ounces (141.75 to 148.83 g) in weight (2014 edition, MLB Official Baseball Rules). Although the test results were carried out with respect to regulation baseball, it should be appreciated that the benefits of the launch angle boosters may be equally applied to other non-regulation baseballs as well as other batted balls, such as softballs. The flight of the ball during and following impact was sensed or captured by a high-speed video camera such as an NAC Memrecam HX-3e camera commercially available from NAC Image Technology, 543 Country Club Dr., Simi Valley, Calif. 93065. The launch angle and spin rate were determined using tracking software such as the TEMA motion analysis software, commercially available from Specialized Imaging Inc., 40935 County Center Dr., Temecula, Calif. 92591.

The spin rate and launch angle information was compared to a first prototype baseball bat having the same characteristics as the stock DeMarini® Voodoo® baseball bat but with grooves 40 formed at approximately 5 degrees from the longitudinal axis of the bat formed on an inner surface of the barrel portion 18 of the bat. The tests illustrate that the first prototype bat produces higher ball spin rates following impact than the stock DeMarini® Voodoo® bat over all of the measured launch angles. Both bats were tested with the bat angled downward at an angle of 5 degrees with the handle portion 16 of the bat fixed in a test support and the end cap side simply supported.

TABLE 3

| Launch Angle (deg) | VBC Stock @ 5 deg (rpm) | SpESys GTC @ 5 deg (rpm) | RPM Delta | % Delta |
|---|---|---|---|---|
| 15 | 1101.3 | 1284.5 | 183.2 | 16.63 |
| 17.5 | 1308.2 | 1463.0 | 154.8 | 11.84 |
| 20 | 1496.3 | 1583.8 | 87.4 | 5.84 |
| 22.5 | 1728.6 | 1839.7 | 111.1 | 6.43 |
| 25 | 1970.6 | 2058.7 | 88.1 | 4.47 |
| 27.5 | 2126.0 | 2182.8 | 56.8 | 2.67 |
| 30 | 2298.3 | 2370.6 | 72.3 | 3.15 |
| 32.5 | 2431.6 | 2498.7 | 67.1 | 2.76 |
| 35 | 2571.2 | 2650.3 | 79.1 | 3.08 |
| | | Average | 100.0 | 6.32 |

Table 4 below is the spin measurements for the Stock DeMarini® Voodoo® bat.

TABLE 4

| Launch Angle | VBC Stock @ 5 deg Rebound Ball Spin (RPM) | | | | | |
|---|---|---|---|---|---|---|
| (deg) | 1 | 2 | 3 | Ave | St Dev | Delta |
| 15 | 1117.147 | 1094.743 | 1091.933 | 1101.27 | 13.82 | |
| 17.5 | 1301.61 | 1314.779 | | 1308.19 | 9.31 | 206.92 |
| 20 | 1496.028 | 1495.244 | 1497.712 | 1496.33 | 1.26 | 188.13 |
| 22.5 | 1729.824 | 1681.81 | 1774.218 | 1728.62 | 46.22 | 232.29 |
| 25 | 1933.894 | 2024.606 | 1953.427 | 1970.64 | 47.74 | 242.02 |
| 27.5 | 2109.158 | 2175.083 | 2093.891 | 2126.04 | 43.15 | 155.40 |
| 30 | 2397.036 | 2239.964 | 2257.953 | 2298.32 | 85.96 | 172.27 |
| 32.5 | 2497.495 | 2362.625 | 2434.619 | 2431.58 | 67.49 | 133.26 |
| 35 | 2594.191 | 2511.153 | 2608.301 | 2571.21 | 52.49 | 139.64 |

Table 5 below is the spin measurements for the first prototype bat.

TABLE 5

| Launch Angle | GTC @ 5 deg Rebound Ball Spin (RPM) | | | | | |
|---|---|---|---|---|---|---|
| (deg) | 1 | 2 | 3 | Ave | St Dev | Delta |
| 15 | 1319.911 | 1250.623 | 1282.828 | 1284.45 | 34.67 | |
| 17.5 | 1475.595 | 1485.489 | 1428.029 | 1463.04 | 30.72 | 178.58 |

TABLE 5-continued

| Launch Angle | GTC @ 5 deg Rebound Ball Spin (RPM) | | | | | |
|---|---|---|---|---|---|---|
| (deg) | 1 | 2 | 3 | Ave | St Dev | Delta |
| 20 | 1571.188 | 1554.031 | 1626.099 | 1583.77 | 37.65 | 120.73 |
| 22.5 | 1872.233 | 1841.677 | 1805.298 | 1839.74 | 33.51 | 255.96 |
| 25 | 2061.2 | 2036.13 | 2078.884 | 2058.74 | 21.48 | 219.00 |
| 27.5 | 2136.4 | 2151.125 | 2260.985 | 2182.84 | 68.08 | 124.10 |
| 30 | 2353.063 | 2352.403 | 2406.464 | 2370.64 | 31.02 | 187.81 |
| 32.5 | 2486.335 | 2487.988 | 2521.69 | 2498.67 | 19.95 | 128.03 |
| 35 | 2633.488 | 2646.368 | 2671.006 | 2650.29 | 19.06 | 151.62 |
| | | | | | 32.91 | 170.73 |

Figure 9A:
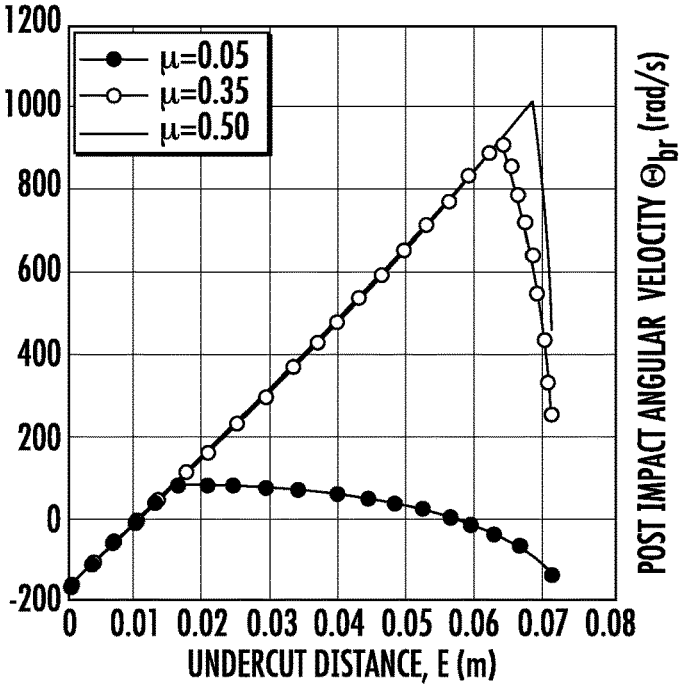
FIG. 9A is a graph illustrating post impact angular velocity with respect to undercut distance.
Figure 9B:
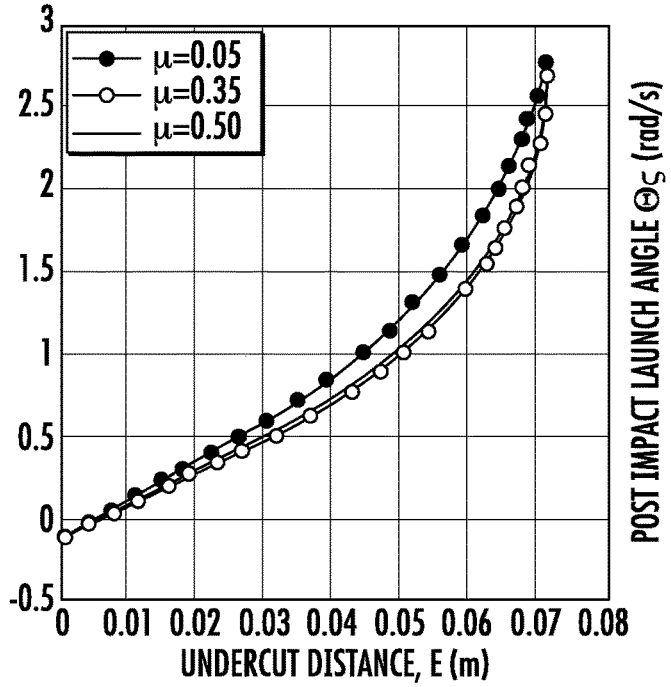
FIG. 9B is a graph illustrating post impact launch angle with respect to undercut distance.

As demonstrated above, on average, the grooves 140, at a 5° angle with respect to the longitudinal axis of the bat, increase the backspin of the ball following impact on average by approximately 100 rpm. Enhanced spin alone may increase ball flight distance. However, ball spin is one component of a ball's true launch condition, with the other two parts being launch angle and exit velocity. It is assumed that as the bat and ball impact becomes more oblique with respect to the centerlines of both round objects, the hit ball will have more spin and larger launch angles. FIGS. 9A and 9B illustrate the direct relationship between undercut distance and a) spin rate and b) launch angle. Ref: Sawicki, G. S. & Hubbard, M. How to hit home runs: Optimum baseball bat swing parameters for maximum range trajectories. American Journal of Physics, 71(11), 1152-1162 (2003).

Figure 10:
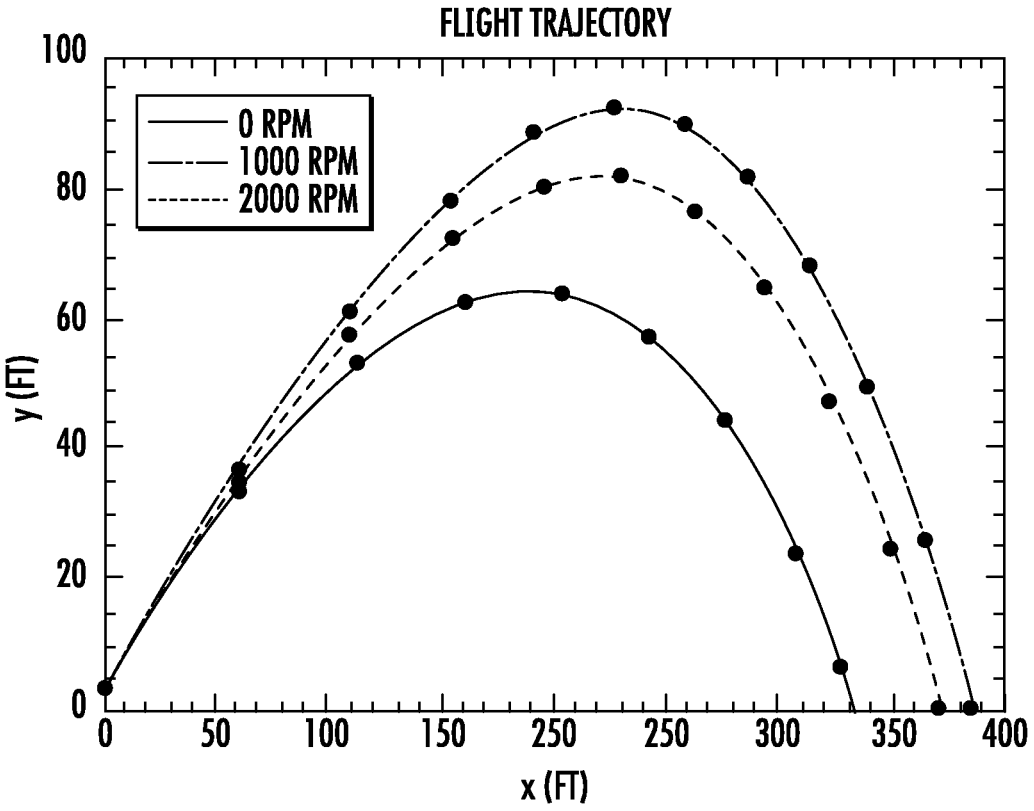
FIG. 10 is a graph illustrating ball flight distance and height for different launch angles.

Although, if the offset is too big, impact quality becomes very poor and ball distance decreases significantly. Because of this, and the fact that a vast majority of home runs are hit with launch angles between 20 and 30 degrees, the present invention provides a ball bat construction that can improve the distance for balls hit at intermediate launch angles. With all other launch conditions being equal, a ball with more revolutions per minute (RPM) back spin will travel farther than a ball with a lower spin rate. FIG. 10 illustrates calculated trajectories of a hit baseball with an initial speed of 100 mph, launch angle of 30 degrees and backspin of 0 rpm (solid), 1000 rpm (long-dashed) and 2000 rpm (short-dashed). Ref: Nathan, A. M. The effect of spin on the flight of a baseball. American Journal of Physics, 76(2), 119-124 (2008). Ball bats built in accordance with the present invention facilitate imparting more spin (RPMs) on hit balls, thereby improving the travel distance of intermediate launch angle fly balls and increasing the number of extra base hits.

Enhanced Launch Angle

Figure 11A:
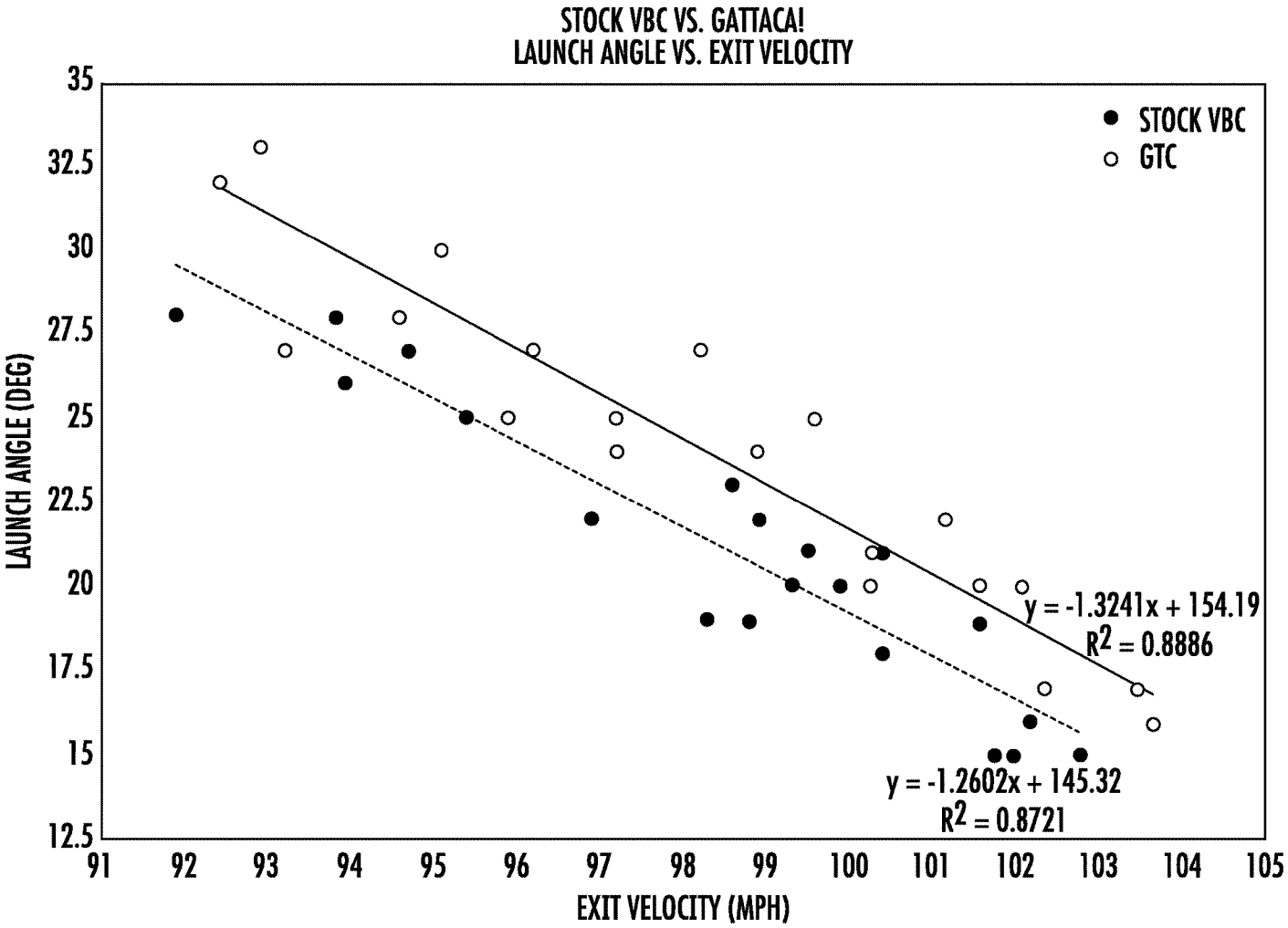
FIG. 11A is a graph of launch angle versus exit velocity for the bat of FIG. 4 with respect to a similar bat lacking launch angle boosters.

In addition to increasing or enhancing spin of the ball for the same given ball impact with the same bat but for grooves 140, grooves 140 additionally enhance the launch angle of the ball 70 following impact with the bat. Tables 6-8 below and FIG. 11A illustrate bat field test results from numerous tests of a ball impacting a bat. As shown by Tables 6-8 for a given exit velocity, grooves 140 facilitate larger or higher launch angles without the corresponding sacrifice in ball exit Velocity. The results illustrate that a bat configured in accordance with an embodiment of the present application, such as bat 110, results in a ball having a larger launch angle as compared to a baseball hit with a bat without the variable wall structure or without grooves 140.

A stock DeMarini® Voodoo® baseball bat was tested with ball impacts having exit velocities from 90 to 105 mph. The exit speed, launch and distance of the ball leaving the bat following impact were recorded using a HitTrax System commercially available from Massachusetts-based InMotion Systems, LLC.

This information was compared to a first prototype baseball bat having the same characteristics as the stock DeMarini® Voodoo® baseball bat but with grooves 140 formed at approximately 5 degrees from the longitudinal axis of the bat formed on an inner surface of the barrel portion 18 of the bat. Table 6 shows the calculated launch angle based on the best fit line for a given exit velocity. The tests illustrate that the first prototype bat produces higher launch angles following impact than the stock DeMarini® Voodoo® bat over all of the measured exit velocities.

TABLE 6

| Velo (mph) | Calc Stock LA (deg) | Calc GTC LA (deg) | Delta | % Increase |
|---|---|---|---|---|
| 90 | 31.902 | 35.021 | 3.119 | 9.7768 |
| 91 | 30.6418 | 33.6969 | 3.0551 | 9.9704 |
| 92 | 29.3816 | 32.3728 | 2.9912 | 10.1805 |
| 93 | 28.1214 | 31.0487 | 2.9273 | 10.4095 |
| 94 | 26.8612 | 29.7246 | 2.8634 | 10.6600 |
| 95 | 25.601 | 28.4005 | 2.7995 | 10.9351 |
| 96 | 24.3408 | 27.0764 | 2.7356 | 11.2387 |
| 97 | 23.0806 | 25.7523 | 2.6717 | 11.5755 |
| 98 | 21.8204 | 24.4282 | 2.6078 | 11.9512 |
| 99 | 20.5602 | 23.1041 | 2.5439 | 12.3729 |
| 100 | 19.3 | 21.78 | 2.48 | 12.8497 |
| 101 | 18.0398 | 20.4559 | 2.4161 | 13.3932 |
| 102 | 16.7796 | 19.1318 | 2.3522 | 14.0182 |
| 103 | 15.5194 | 17.8077 | 2.2883 | 14.7448 |
| 104 | 14.2592 | 16.4836 | 2.2244 | 15.5998 |
| 105 | 12.999 | 15.1595 | 2.1605 | 16.6205 |
| | | Average | 2.63975 | 12.2686 |

Table 7 below is the exit speed/exit velocity measurements for the Stock DeMarini® Voodoo® bat.

| Stock VBC | | | |
|---|---|---|---|
| Date | Exit Speed | Launch | Distance |
| Oct. 6, 2017 | 102.8 | 15 | 300 |
| Oct. 6, 2017 | 101.8 | 15 | 293 |
| Oct. 11, 2017 | 102 | 15 | 302 |
| Oct. 11, 2017 | 102.2 | 16 | 315 |
| Oct. 19, 2017 | 100.4 | 18 | 323 |
| Oct. 6, 2017 | 101.6 | 19 | 350 |
| Oct. 11, 2017 | 98.8 | 19 | 324 |
| Oct. 19, 2017 | 98.3 | 19 | 325 |
| Oct. 6, 2017 | 100.3 | 20 | 348 |
| Oct. 6, 2017 | 99.3 | 20 | 344 |
| Oct. 19, 2017 | 99.9 | 20 | 349 |
| Oct. 6, 2017 | 99.5 | 21 | 351 |
| Oct. 6, 2017 | 100.4 | 21 | 360 |
| Oct. 11, 2017 | 98.9 | 22 | 358 |
| Nov. 6, 2017 | 96.9 | 22 | 345 |
| Oct. 11, 2017 | 98.6 | 23 | 366 |
| Oct. 11, 2017 | 97.2 | 25 | 370 |
| Nov. 6, 2017 | 95.4 | 25 | 359 |
| Oct. 11, 2017 | 93.9 | 26 | 359 |
| Oct. 6, 2017 | 94.7 | 27 | 366 |
| Oct. 6, 2017 | 93.8 | 28 | 367 |
| Oct. 19, 2017 | 91.9 | 28 | 357 |

Table 8 below is the exit speed/exit velocity measurements for the first prototype bat.

| GTC CFRH RD17-628 | | | |
|---|---|---|---|
| Date | Exit Speed | Launch | Distance |
| Oct. 11, 2017 | 103.7 | 16 | 325 |
| Oct. 6, 2017 | 102.4 | 17 | 331 |
| Nov. 6, 2017 | 103.5 | 17 | 327 |
| Oct. 6, 2017 | 101.6 | 20 | 357 |
| Oct. 6, 2017 | 99.7 | 20 | 342 |
| Oct. 11, 2017 | 102.1 | 20 | 359 |
| Oct. 19, 2017 | 100.3 | 20 | 348 |
| Nov. 6, 2017 | 101.6 | 20 | 354 |
| Oct. 6, 2017 | 100.3 | 21 | 364 |
| Oct. 11, 2017 | 101.2 | 22 | 372 |
| Oct. 6, 2017 | 97.2 | 24 | 366 |
| Nov. 6, 2017 | 98.9 | 24 | 377 |
| Oct. 6, 2017 | 99.6 | 25 | 386 |
| Oct. 11, 2017 | 97.2 | 25 | 373 |
| Nov. 6, 2017 | 95.9 | 25 | 363 |
| Oct. 11, 2017 | 93.2 | 27 | 361 |
| Oct. 11, 2017 | 98.2 | 27 | 392 |
| Oct. 19, 2017 | 96.2 | 27 | 378 |
| Oct. 6, 2017 | 94.6 | 28 | 374 |
| Oct. 11, 2017 | 95.1 | 30 | 385 |
| Oct. 11, 2017 | 92.4 | 32 | 374 |
| Oct. 11, 2017 | 92.9 | 33 | 382 |
| Nov. 6, 2017 | 92.9 | 33 | 383 |

Enhanced Exit Velocity

Figure 11B:
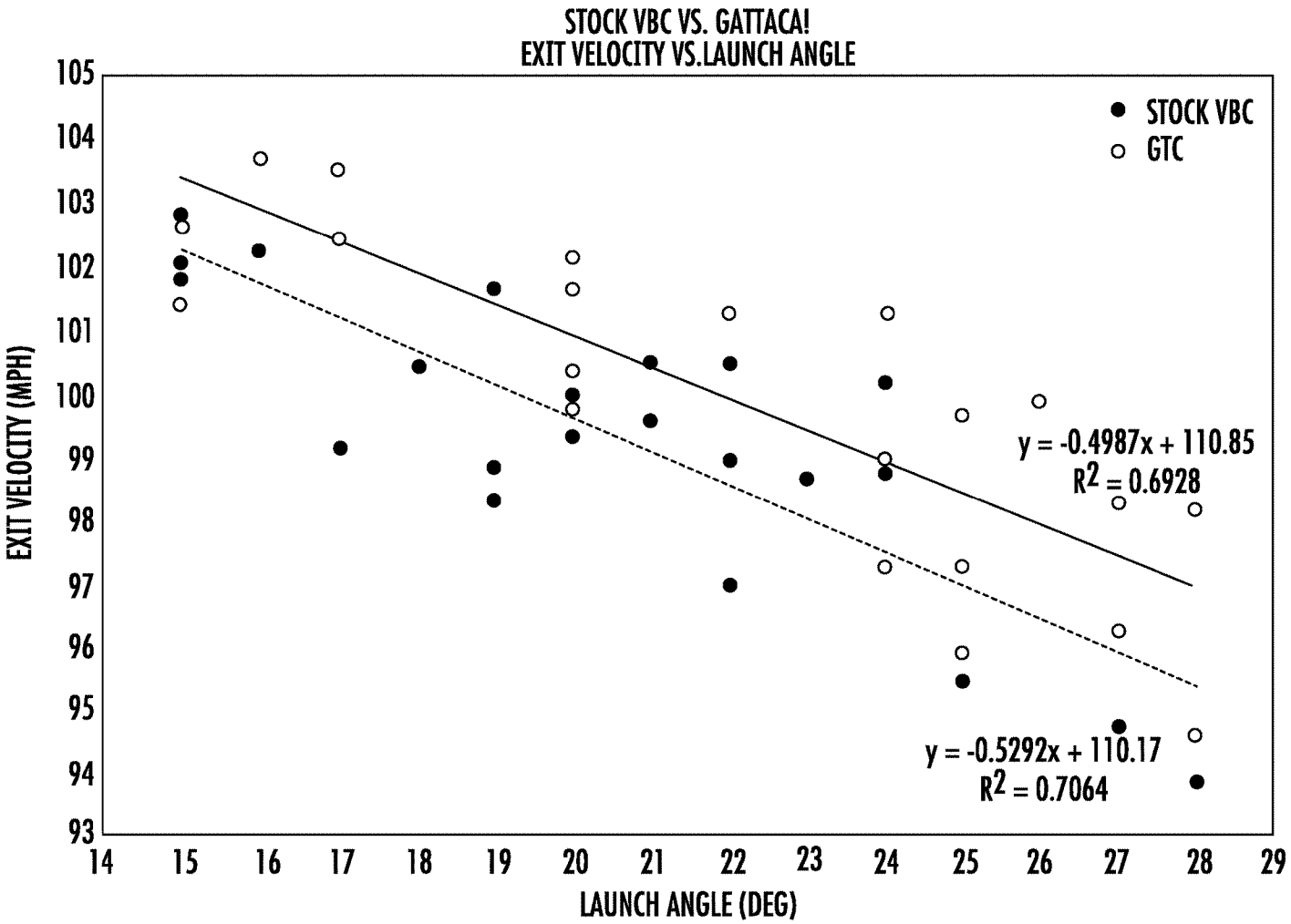
FIG. 11B is a graph of exit velocity versus launch angle for the bat of FIG. 4 with respect to a similar bat lacking launch angle boosters.

In addition to increasing or enhancing spin and launch angle of the ball for the same given ball impact with the same bat but for grooves 140, grooves 140 additionally enhance the exit velocity of the ball 70 following impact with the bat. Tables 9-11 below and FIG. 11B illustrate bat field test results from numerous tests of a ball impacting a bat. As shown by Tables 9-11 for a given launch angle, grooves 140 facilitate larger exit velocities without the corresponding sacrifice in launch angle. The results illustrate that a bat configured in accordance with an embodiment of the present application, such as bat 110, results in a ball having a greater exit velocity as compared to a baseball hit with a bat without the variable wall structure or without grooves 140.

A stock DeMarini® Voodoo® baseball bat was tested with ball impacts occurring over launch angles of 15 degrees to 30 degrees. The exit speed, launch and distance of the ball leaving the bat following impact were recorded using infrared cameras. In the example illustrated, such data was measured using the HitTrax System.

This information was compared to a first prototype baseball bat having the same characteristics as the stock DeMarini® Voodoo® baseball bat but with grooves 140 formed at approximately 5 degrees from the longitudinal axis of the bat formed on an inner surface of the barrel portion 18 of the bat. Table 9 shows the calculated launch angle based on the best-fit line for a given launch angle. The tests illustrate that the first prototype bat produces higher exit velocities following impact than the stock DeMarini® Voodoo® bat over all of the measured launch angles.

Tables 9-11 provide the calculated exit velocity based on the best fit line for a given launch angle.

TABLE 9

| LA (deg) | Calc Stock Velo (mph) | Calc GTC Velo (mph) | Delta | % Inc |
|---|---|---|---|---|
| 15 | 102.232 | 103.3695 | 1.1375 | 1.1127 |
| 16 | 101.7028 | 102.8708 | 1.168 | 1.1484 |

TABLE 9-continued

| LA (deg) | Calc Stock Velo (mph) | Calc GTC Velo (mph) | Delta | % Inc |
|---|---|---|---|---|
| 17 | 101.1736 | 102.3721 | 1.1985 | 1.1846 |
| 18 | 100.6444 | 101.8734 | 1.229 | 1.2211 |
| 19 | 100.1152 | 101.3747 | 1.2595 | 1.2581 |
| 20 | 99.586 | 100.876 | 1.29 | 1.2954 |
| 21 | 99.0568 | 100.3773 | 1.3205 | 1.3331 |
| 22 | 98.5276 | 99.8786 | 1.351 | 1.3712 |
| 23 | 97.9984 | 99.3799 | 1.3815 | 1.4097 |
| 24 | 97.4692 | 98.8812 | 1.412 | 1.4487 |
| 25 | 96.94 | 98.3825 | 1.4425 | 1.4880 |
| 26 | 96.4108 | 97.8838 | 1.473 | 1.5278 |
| 27 | 95.8816 | 97.3851 | 1.5035 | 1.5681 |
| 28 | 95.3524 | 96.8864 | 1.534 | 1.6088 |
| 29 | 94.8232 | 96.3877 | 1.5645 | 1.6499 |
| 30 | 94.294 | 95.889 | 1.595 | 1.6915 |
| | | Average | 1.3662 | 1.3948 |

Table 10 below is the exit speed/exit velocity measurements for the Stock DeMarini® Voodoo® bat.

| Stock VBC | | | |
|---|---|---|---|
| Date | Exit Speed | Launch | Distance |
| Oct. 6, 2017 | 102.8 | 15 | 300 |
| Oct. 6, 2017 | 101.8 | 15 | 293 |
| Oct. 11, 2017 | 102 | 15 | 302 |
| Oct. 11, 2017 | 102.2 | 16 | 315 |
| Oct. 6, 2017 | 99.1 | 17 | 304 |
| Oct. 19, 2017 | 100.4 | 18 | 323 |
| Oct. 6, 2017 | 101.6 | 19 | 350 |
| Oct. 11, 2017 | 98.8 | 19 | 324 |
| Oct. 19, 2017 | 98.3 | 19 | 325 |
| Oct. 6, 2017 | 100.3 | 20 | 348 |
| Oct. 6, 2017 | 99.3 | 20 | 344 |
| Oct. 19, 2017 | 99.9 | 20 | 349 |
| Oct. 6, 2017 | 99.5 | 21 | 351 |
| Nov. 6, 2017 | 100.4 | 21 | 360 |
| Oct. 11, 2017 | 98.9 | 22 | 358 |
| Nov. 6, 2017 | 100.4 | 22 | 367 |
| Nov. 6, 2017 | 96.9 | 22 | 345 |
| Oct. 11, 2017 | 98.6 | 23 | 366 |
| Oct. 11, 2017 | 100.1 | 24 | 380 |
| Nov. 6, 2017 | 98.7 | 24 | 371 |
| Oct. 11, 2017 | 97.2 | 25 | 370 |
| Nov. 6, 2017 | 95.4 | 25 | 359 |
| Oct. 6, 2017 | 94.7 | 27 | 366 |
| Oct. 6, 2017 | 93.8 | 28 | 367 |

Table 11 below is the exit speed/exit velocity measurements for the first prototype bat.

| GTC CFRH RD17-628 | | | |
|---|---|---|---|
| Date | Exit Speed | Launch | Distance |
| Oct. 19, 2017 | 102.6 | 15 | 297 |
| Nov. 6, 2017 | 101.4 | 15 | 295 |
| Oct. 11, 2017 | 103.7 | 16 | 325 |
| Oct. 6, 2017 | 102.4 | 17 | 331 |
| Nov. 6, 2017 | 103.5 | 17 | 327 |
| Oct. 6, 2017 | 101.6 | 20 | 357 |
| Oct. 6, 2017 | 99.7 | 20 | 342 |
| Oct. 11, 2017 | 102.1 | 20 | 359 |
| Oct. 19, 2017 | 100.3 | 20 | 348 |
| Nov. 6, 2017 | 101.6 | 20 | 354 |
| Oct. 6, 2017 | 100.3 | 21 | 364 |
| Oct. 11, 2017 | 101.2 | 22 | 372 |
| Oct. 6, 2017 | 97.2 | 24 | 366 |
| Oct. 11, 2017 | 101.2 | 24 | 393 |
| Nov. 6, 2017 | 98.9 | 24 | 377 |
| Oct. 6, 2017 | 99.6 | 25 | 386 |

-continued

| GTC CFRH RD17-628 | | | |
|---|---|---|---|
| Date | Exit Speed | Launch | Distance |
| Oct. 11, 2017 | 97.2 | 25 | 373 |
| Nov. 6, 2017 | 95.9 | 25 | 363 |
| Oct. 6, 2017 | 99.8 | 26 | 395 |
| Oct. 11, 2017 | 98.2 | 27 | 392 |
| Oct. 19, 2017 | 96.2 | 27 | 378 |
| Oct. 6, 2017 | 94.6 | 28 | 374 |
| Oct. 11, 2017 | 98.1 | 28 | 397 |

As demonstrated above, on average, the grooves 140, at a 5° angle with respect to the longitudinal axis of the bat, increase exit velocity of the baseball on average by approximately 1.4 mph.

Increased Ball Flight Distance

FIG. 12 illustrates the theoretical expected flight distance achieved by use of ball bat 110 with grooves 140 as compared to use of the same ball bat without grooves 140 based upon the above tests. As shown below, the use of bat 110 with grooves 140 as compared to use of the same ball bat without grooves 140 yield a theoretical increase in flight distance from 9 to 15 feet. Table 200 of FIG. 12 illustrates a calculated ball flight distance for the stock DeMarini® Voodoo® bat for different launch angles (15-40) with different exit velocities (100, 95 and 90) and with different back spin values. Table 202 of FIG. 12 illustrates a calculated ball flight distance for the stock DeMarini® Voodoo® bat for the same different launch angles (15-40) with different exit velocities (102, 97 and 92) with different back spin values.

Table 202 of FIG. 12 reflects the results of the tests discussed above in that the exit velocities and the back spin values are incremented in accordance with the higher exit velocities and higher back spin values produced for the same launch angles using the bat with grooves 140 in the above tests. In particular, the above tests reflected an overall average increase in back spin of 100 RPM. Accordingly, FIG. 12 illustrates a comparison of ball flight distance for a baseball hit with the stock DeMarini® Voodoo® bat having a back spin of 1000 RPM with the flight distance for a baseball hit with bat 110 which would achieve a ball with a back spin of 1150 RPM. This difference is reflected throughout table 202 for each of the launch angles at which ball flight distance was calculated. The lab test results of Table 3 illustrate different spin rate increases at different launch angle ranges. The increases in spin rates of batted balls for the three different launch angle categories or ranges include: low launch angle (+150 rpm), middle launch angle (+100 rpm) and high launch angle (+75 rpm).

As demonstrated above by the tests, use of bat 110 with grooves 140 achieves, on average, an increase in exit velocity of 1.4 mph, for a given launch angle. Table 202 calculates ball flight distance for a ball hit by the bat 110 having grooves 140 conservatively based upon an increase in exit velocity of 2.0 mph. Accordingly, FIG. 12 illustrates a comparison of a ball flight distance for a baseball hit with a stock DeMarini® Voodoo® bat having exit velocities of 100 mph, 95 mph and 90 mph with the flight distance for a baseball hit with a bat 110 having grooves 140 having exit velocities of 102 mph, 97 mph and 92 mph, respectively. The three different velocities reflect the inversely proportional relationship between increases in launch angle and decreases in exit velocities. The exit velocities observed for three separate groupings or categories of launch angles include: low launch angle (15-22.5 deg), middle launch angle (25-30 deg) and high launch angle (32.5-40 deg).

As reflected by table 204 of FIG. 12, the combination of increased back spin and increased exit velocity for a given launch angle results in greater ball flight distance. By combining the spin rate gains observed in a controlled lab setting with the velocity gains measured for a given launch angle in the field, a distance gain of 9-15 ft can be expected. Where a given batted ball falls in this distance range boost depends on the three ball launch condition variables: spin rate, exit velocity and launch angle. This data was calculated using Professor Alan Nathan's trajectory calculator and is based on launch condition inputs. (http://baseball.physics.illinois.edu/trajectory-calculator.html).

The above tests and results were carried out with the baseball bat having grooves 140 at an angle of 5° from the longitudinal axis of the baseball bat. In other implementations, the ball bat 110 can be formed with grooves angled with respect to the longitudinal axis 14 at 3 degrees, 3.8 degrees, 4 degrees, 4.5 degrees, 5 degrees, 5.5 degrees, 6 degrees, 6.5 degrees, 7.0 degrees, 7.5 degrees, 8 degrees, and other values within the range of 2 to 12 degrees. The alignment of the grooves 140 within the barrel portion 18 makes the bat best fit for a right-handed batter or a left-handed batter depending upon the particular angle with respect to the longitudinal axis 14.

Figure 13:
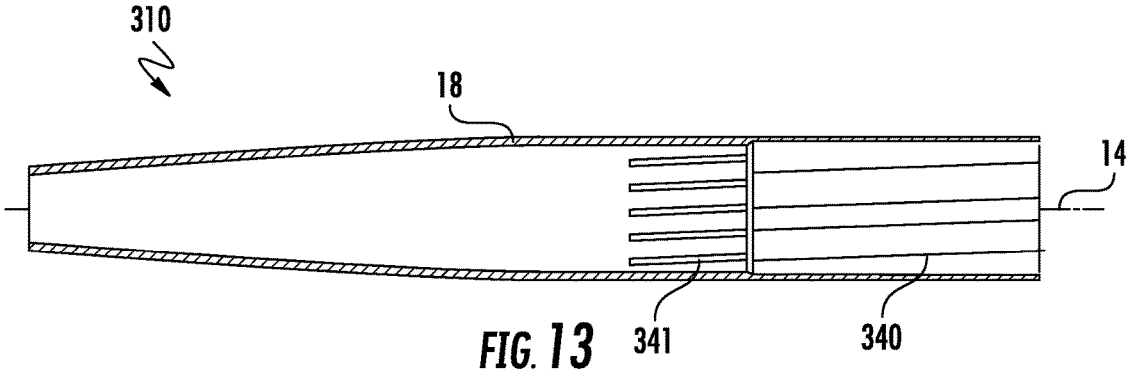
FIG. 13 is a sectional view of portions of an example ball bat.

FIG. 13 is a sectional view illustrating another example baseball bat 310. Bat 310 is similar to bat 110 except that bat 310 has grooves 340 and 341. Grooves 340 are angled from longitudinal axis 14 by 4 degrees. grooves 341 extend along the interior circumferential surface of bat 310 between grooves 340 and the proximal end of barrel 18 (the end towards the handle of the bat). Bat 310 may produce higher back spin values and larger exit velocities for a ball hit by a batter having a lesser downward tilt of the bat at the point of impact, more closely approximating the 4° angle of grooves 340. In other words, grooves 340 will be more parallel to the ground at the point of them back for a batter having a swing plane which results in the barrel portion of the bat angled downward toward the ground at a smaller angle closer to 4°.

Figure 14A:
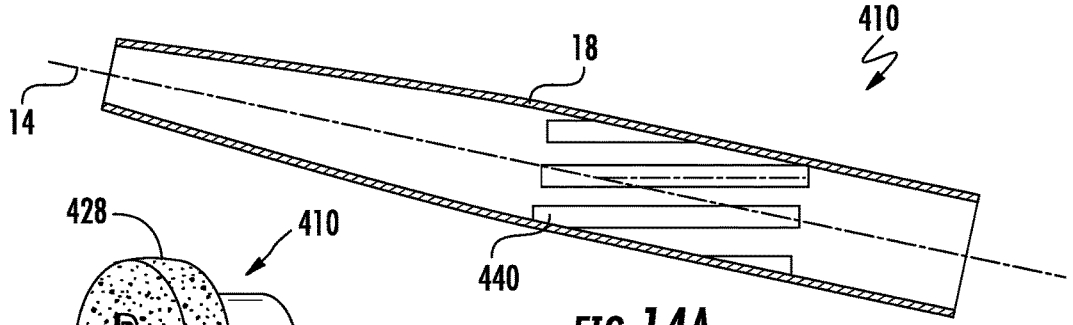
FIG. 14A is a sectional view of portions of an example ball bat designated for a right-handed batter.

FIG. 14A is a sectional view illustrating another example baseball bat 410. Bat 410 is similar to bat 110 except that bat 410 has grooves 440 which are angled from longitudinal axis 14 by 10°. Bat 410 may produce higher back spin values and larger exit velocities for a ball hit by a batter having a larger downward tilt of the bat at the point of impact, more closely approximating the 10° angle of grooves 440. In other words, grooves 340 will be more parallel to the ground at the point of them back for a batter having a swing plane which results in the barrel portion of the bat angled downward toward the ground at a smaller angle closer to 4°.

Figure 15A:
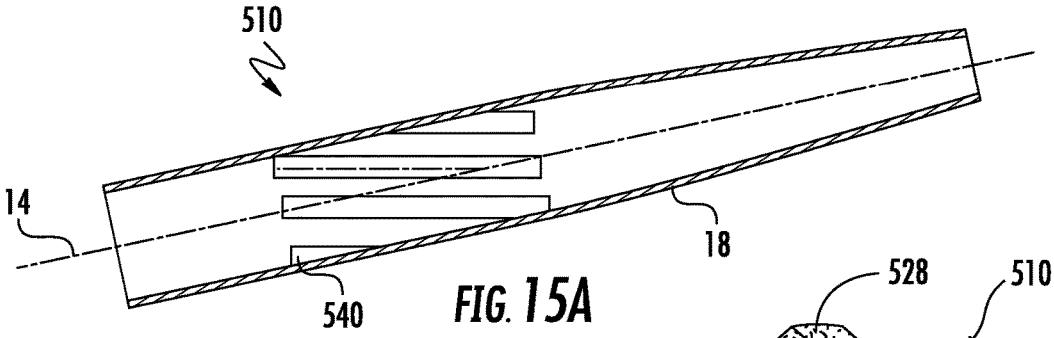
FIG. 15A is a sectional view of portions of an example ball bat designated for a left-handed batter.

Each of bats 10, 110, 310 and 410 described above are right-handed bats, bats for right-handed batters. With each of bats 10, 110, 310 and 410, the grooves 140 are angled in a clockwise (to the right) direction about longitudinal axis 14 as they extend away from handle portion 16 and as seen from the distal end of the baseball bat (the end opposite to the handle portion 16) (See FIG. 6). Each of bats 10, 110, 310 and 410 may be modified for left-handed batters. FIG. 15A is a sectional view of a left-hand designated bat 510. Bat 510 is similar to bat 410 in all respects except that bat 510 comprises grooves 540, wherein each of grooves 540, the grooves 140 are angled in a counterclockwise (to the left) direction about longitudinal axis 14 as they extend away from handle portion 16 and as seen from the distal end of the baseball bat (the end opposite to the handle portion 16).

In one implementation, bats 410 and 510 may be provided with different indicia that indicates to a batter whether the particular bat is configured and designated for a right-handed batter (such as bat 410) or a left-handed batter (such as bat 510). In some implementations, absent such indicia, the exterior of left-hand bats and right-handed bats may be identical. In one implementation, the indicia may comprise engravings, markings, stickers or other forms of surface treatments to portions of the exterior of bats 410 and 510. In yet other implementations, predetermined portions of bats 410 and 510 may be differently colored, textured or the like, or the different colors and textures indicates whether the bat is a left-hand bat or a right-hand bat. In still other implementations, distinct predetermined portions of the bats 410 and 510 may have different shapes. For example, the end cap or the knobs of such bats 410 and 510 may be differently shaped to indicate whether the particular bat is a left-hand bat or a right-hand bat.

Figure 14B:
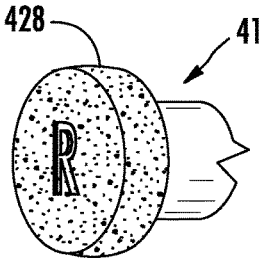
FIG. 14B is a fragmentary end perspective view of the bat of FIG. 14A.
Figure 15B:
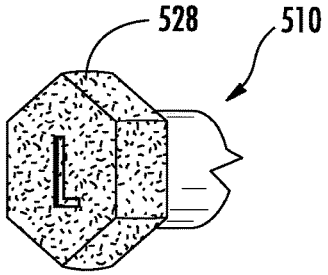
FIG. 15B is a fragmentary end perspective view of the bat of FIG. 15A.

FIGS. 14B and 15B are fragmentary end views or perspective views of knobs 428 and 528 of bats 410 and 510 which provide right-hand indicia 443 and left-hand indicia 543, respectively. Left-hand indicia 443 has a different color, shape and surface treatment as compared to indicia 543. In the example illustrated, right-hand indicia 443 and left-hand indicia 543 are differently shaped knobs having different colors and having different graphic or textual engravings in the knobs. In the example illustrated, right-hand indicia 443 comprises an engraved "R" in the axial end of the knob while left-hand indicia 543 comprises an engraved "L" in the axial end of the knob. In the example illustrated, the bottom of knob 428 is circular or oval while the bottom of knob 528 has a shape of a polygon. In the example illustrated, at least portions of knob 428 are provided with a first color or texture (as indicated by stippling) while at least portions of knob 528 are provided with a second different color or texture (as indicated by different stippling). In other implementations, such indicia 443 and 543 many different one another in other fashions or in less than all of color, shape and surface treatment.

Figure 16:
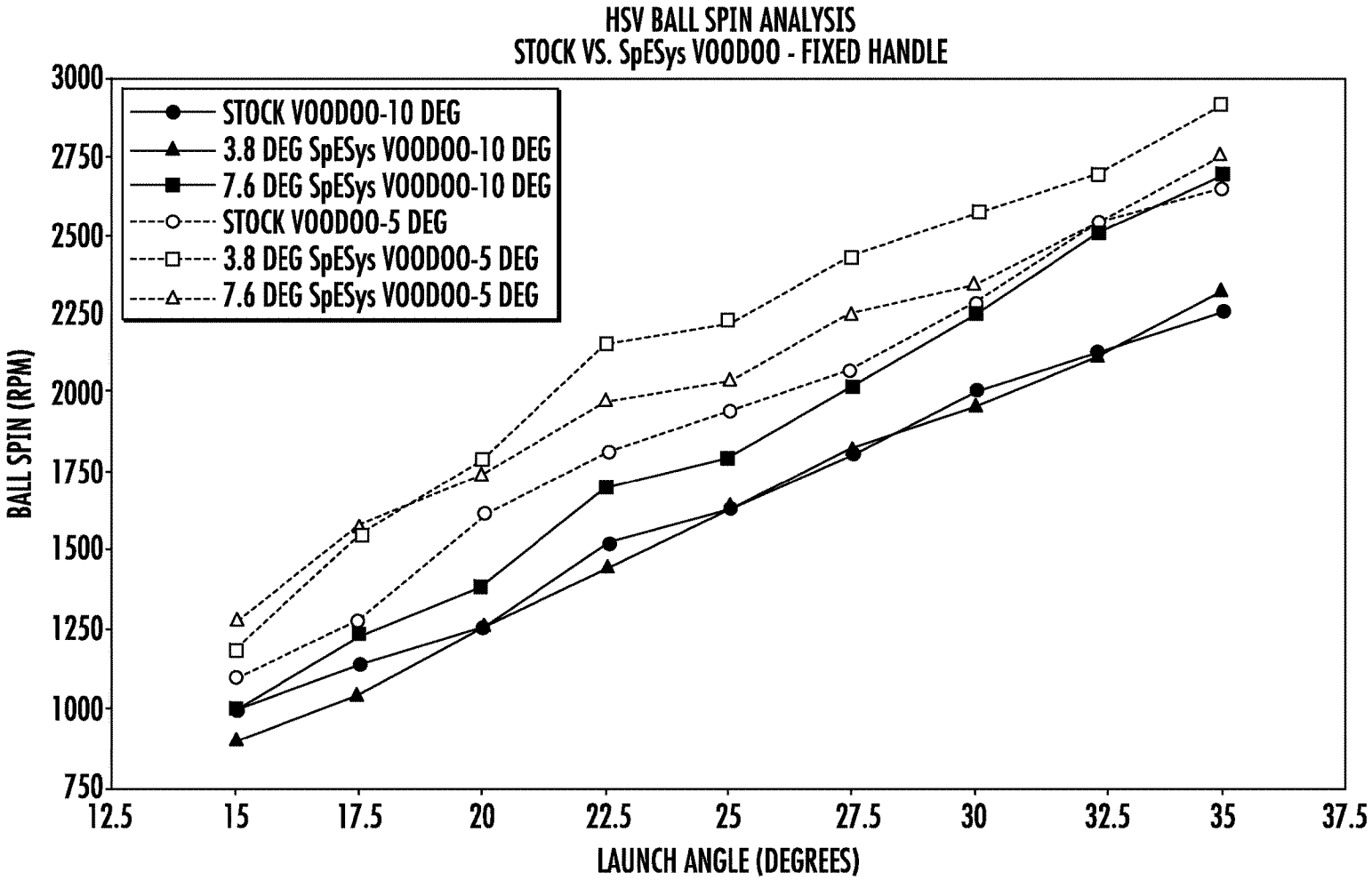
FIG. 16 is a graph of launch angle versus ball spin for different bats held at different angles and having launch angle booster grooves at different angles with respect to a longitudinal axis of the respective bat.

As discussed above, the launch angle boosters 40, such as in the form of grooves 140, may alternatively extend along the longitudinal axis 14 at an angle of at least 3° and no greater than 12° from the longitudinal axis. Table 6 below is a summary of numerous ball/bat lab spin test results of a second prototype bat having grooves that are angled at approximately 7.6 degrees from the longitudinal axis of the bat, a third prototype bat in which the grooves are angled at approximately 3.8 degrees from the longitudinal axis, and a stock DeMarini® Voodoo® ball bat. The bats were then tested with the handle portions fixed at a 5 degree angle with respect to a horizontal plane (or the ground) and at a 10 degree angle with respect to a horizontal plane. FIG. 16 graphically illustrates the data from Table 12 below.

TABLE 12

| Launch Angle (deg) | 7.6 BB Ave Ball Spin 10 deg-Fixed (rpm) | 3.8 BB ave Ball Spin 10 deg-Fixed Handle (rpm) | 7.6 BB ave Ball Spin 10 deg-Fixed Handle (rpm) | 3.8 BB ave Ball Spin 5 deg-Fixed Handle (rpm) | 7.6 BB ave Ball Spin 5 deg-Fixed Handle (rpm) |
|---|---|---|---|---|---|
| 15 | 1139.3 | 897.8 | 1005.2 | 1189.1 | 1281.19 |
| 17.5 | 1232.8 | 1038.3 | 1233.1 | 1556.8 | 1575.15 |
| 20 | 1540.6 | 1266.7 | 1378.7 | 1785.2 | 1735.23 |
| 22.5 | 1651.5 | 1435.6 | 1693.4 | 2147.3 | 1974.12 |
| 25 | 1816.4 | 1639.7 | 1785.6 | 2216.2 | 2035.98 |
| 27.5 | 2139.9 | 1819.4 | 2003.3 | 2413.3 | 2236.30 |
| 30 | 2151.2 | 1947.1 | 2236.1 | 2548.5 | 2329.85 |
| 32.5 | 2252.9 | 2095.3 | 2481.4 | 2671.0 | 2523.59 |
| 35 | 2670.4 | 2305.1 | 2677.8 | 2889.6 | 2739.32 |
| | Std. Dev. 72.63 | Std. Dev. 70.30 | Std. Dev. 83.06 | Std. Dev. 79.58 | Std. Dev. 67.53 |

| Launch Angle (deg) | Rebound Ball Spin (RPM) 1 | 2 | 3 | Ave | St Dev | Delta |
|---|---|---|---|---|---|---|
| SpESys 3.8 @ 5 deg | | | | | | |
| 15 | 1076.4 | 1077.68 | 1413.38 | 1189.14 | 194.19 | |
| 17.5 | 1629.1 | 1502.12 | 1539.25 | 1556.83 | 65.29 | 367.69 |
| 20 | 1835.4 | 1718.09 | 1802.07 | 1785.19 | 60.46 | 228.36 |
| 22.5 | 2081.2 | 2193.31 | 2167.54 | 2147.33 | 58.74 | 362.15 |
| 25 | 2234.4 | 2221.56 | 2192.64 | 2216.21 | 21.40 | 68.88 |
| 27.5 | 2444.9 | 2368.97 | 2425.93 | 2413.26 | 39.50 | 197.05 |
| 30 | 2564.4 | 2599.07 | 2482.11 | 2548.54 | 60.08 | 135.28 |
| 32.5 | 2687.7 | 2701.50 | 2623.86 | 2671.01 | 41.41 | 122.48 |
| 35 | 2857.2 | 2877.06 | 2934.43 | 2889.56 | 40.11 | 218.55 |
| | | | | Average | 64.58 | 212.55 |
| SpESys 3.8 @ 10 deg | | | | | | |
| 15 | 885.35 | 908.95 | 898.99 | 897.76 | 11.85 | |
| 17.5 | 986.07 | 1022.30 | 1106.59 | 1038.32 | 61.84 | 140.55 |
| 20 | 1295.72 | 1270.09 | 1234.37 | 1266.73 | 30.81 | 228.41 |
| 22.5 | 1521.74 | 1354.42 | 1430.77 | 1435.65 | 83.77 | 168.92 |
| 25 | 1615.03 | 1687.91 | 1616.03 | 1639.66 | 41.79 | 204.01 |

TABLE 12-continued

| | | | | | | |
|---|---|---|---|---|---|---|
| 27.5 | 1881.53 | 1835.66 | 1741.12 | 1819.43 | 71.60 | 179.78 |
| 30 | 1966.92 | 1932.44 | 1941.96 | 1947.11 | 17.81 | 127.67 |
| 32.5 | 2236.31 | 2050.67 | 1998.78 | 2095.25 | 124.88 | 148.15 |
| 35 | 2273.95 | 2284.52 | 2356.74 | 2305.07 | 45.05 | 209.82 |
| | | | | Average | 54.38 | 175.91 |
| SpESys 7.6 @ 5 deg | | | | | | |
| 15 | 1308.95 | 1300.80 | 1233.83 | 1281.19 | 41.22 | |
| 17.5 | 1481.25 | 1634.12 | 1610.09 | 1575.15 | 82.20 | 293.96 |
| 20 | 1710.05 | 1761.29 | 1734.36 | 1735.23 | 25.63 | 160.08 |
| 22.5 | 1997.32 | 1955.74 | 1969.30 | 1974.12 | 21.21 | 238.89 |
| 25 | 2088.50 | 2014.15 | 2005.30 | 2035.98 | 45.69 | 61.86 |
| 27.5 | 2190.86 | 2215.77 | 2302.27 | 2236.30 | 58.47 | 200.32 |
| 30 | 2327.23 | 2381.92 | 2280.40 | 2329.85 | 50.81 | 93.55 |
| 32.5 | 2600.78 | 2560.52 | 2409.48 | 2523.59 | 100.86 | 193.74 |
| 35 | 2708.83 | 2831.14 | 2677.99 | 2739.32 | 81.00 | 215.73 |
| | | | | Average | 56.34 | 182.27 |
| SpESys 7.6 @ 10 deg | | | | | | |
| 15 | 1128.9 | 912.02 | 974.80 | 1005.25 | 111.60 | |
| 17.5 | 1312.12 | 1224.47 | 1162.59 | 1233.06 | 75.14 | 227.81 |
| 20 | 1354.18 | 1403.72 | 1378.16 | 1378.69 | 24.77 | 145.63 |
| 22.5 | 1689.45 | 1664.74 | 1726.06 | 1693.42 | 30.85 | 314.73 |
| 25 | 1805.50 | 1746.31 | 1804.96 | 1785.59 | 34.02 | 92.17 |
| 27.5 | 1986.39 | 2051.58 | 1971.80 | 2003.26 | 42.48 | 217.66 |
| 30 | 2294.69 | 2183.33 | 2230.28 | 2236.10 | 55.91 | 232.84 |
| 32.5 | 2362.6 | 2526.78 | 2554.74 | 2481.38 | 103.80 | 245.28 |
| 35 | 2784.31 | 2614.44 | 2634.52 | 2677.76 | 92.82 | 196.38 |
| | | | | Average | 63.49 | 209.06 |

| 5 deg Voodoo | Rebound Ball Spin (RPM) | | | | |
|---|---|---|---|---|---|
| Launch Angle (deg) | Stock @ 5 deg | SpESys 3.8 @ 5 deg | 3.8% Delta | SpESys 7.6 @ 5 deg | 7.6% Delta |
| 15 | 1093.3 | 1189.1 | 8.8 | 1281.19 | 17.2 |
| 17.5 | 1271.5 | 1556.8 | 22.4 | 1575.15 | 23.9 |
| 20 | 1617.4 | 1785.2 | 10.4 | 1735.23 | 7.3 |
| 22.5 | 1803.6 | 2147.3 | 19.1 | 1974.12 | 9.5 |
| 25 | 1940.3 | 2216.2 | 14.2 | 2035.98 | 4.9 |
| 27.5 | 2056.5 | 2413.3 | 17.3 | 2236.30 | 8.7 |
| 30 | 2264.6 | 2548.5 | 12.5 | 2329.85 | 2.9 |
| 32.5 | 2516.7 | 2671.0 | 6.1 | 2523.59 | 0.3 |
| 35 | 2624.1 | 2889.6 | 10.1 | 2739.32 | 4.4 |
| | | Average Delta % | 13.4 | Average Delta % | 8.8 |

| 10 deg Voodoo | Rebound Ball Spin (RPM) | | | | |
|---|---|---|---|---|---|
| Launch Angle (deg) | Stock @ 10 deg | SpESys @ 10 deg | 3.8 3.8% Delta | SpESys 7.6 @ 10 deg | % Delta |
| 15 | 1000.8 | 897.76 | −10.3 | 1005.2 | 0.4 |
| 17.5 | 1139.7 | 1038.32 | −8.9 | 1233.1 | 8.2 |
| 20 | 1252.5 | 1266.73 | 1.1 | 1378.7 | 10.1 |
| 22.5 | 1505.5 | 1435.65 | −4.6 | 1693.4 | 12.5 |
| 25 | 1629.1 | 1639.66 | 0.6 | 1785.6 | 9.6 |
| 27.5 | 1796.9 | 1819.43 | 1.3 | 2003.3 | 11.5 |
| 30 | 1991.5 | 1947.11 | −2.2 | 2236.1 | 12.3 |
| 32.5 | 2111.5 | 2095.25 | −0.8 | 2481.4 | 17.5 |
| 35 | 2238.2 | 2305.07 | 3.0 | 2677.8 | 19.6 |
| | | Average Delta % | −2.3 | Average Delta % | 11.3 |

Figure 24:
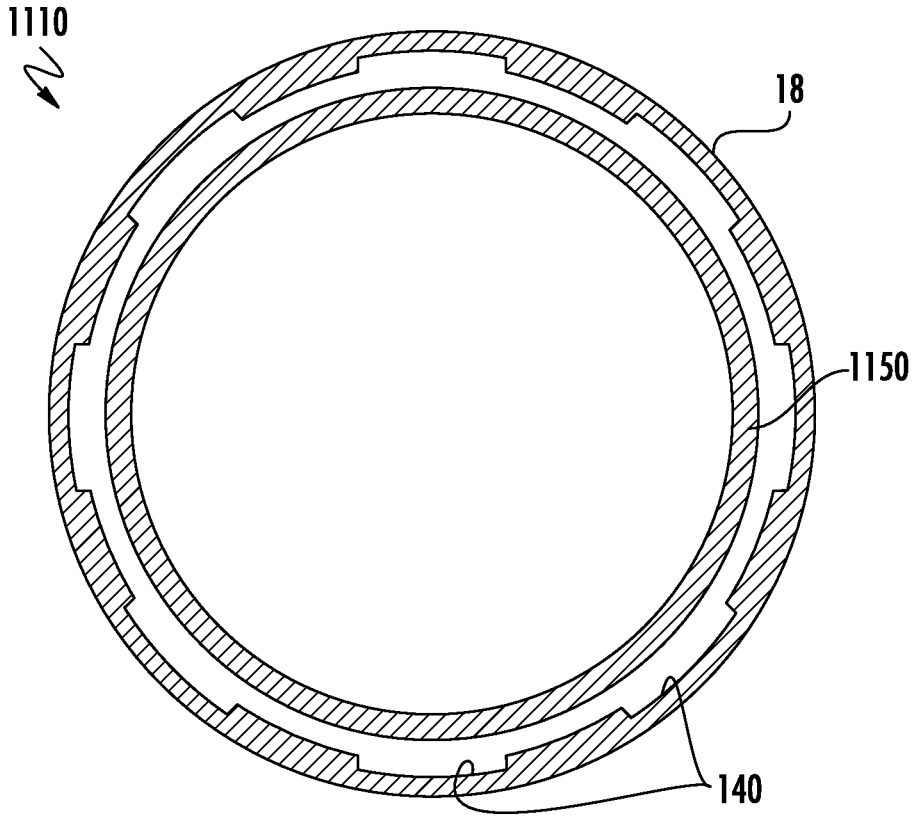
FIG. 24 is a cross-sectional view of an example ball bat.
Figure 25:
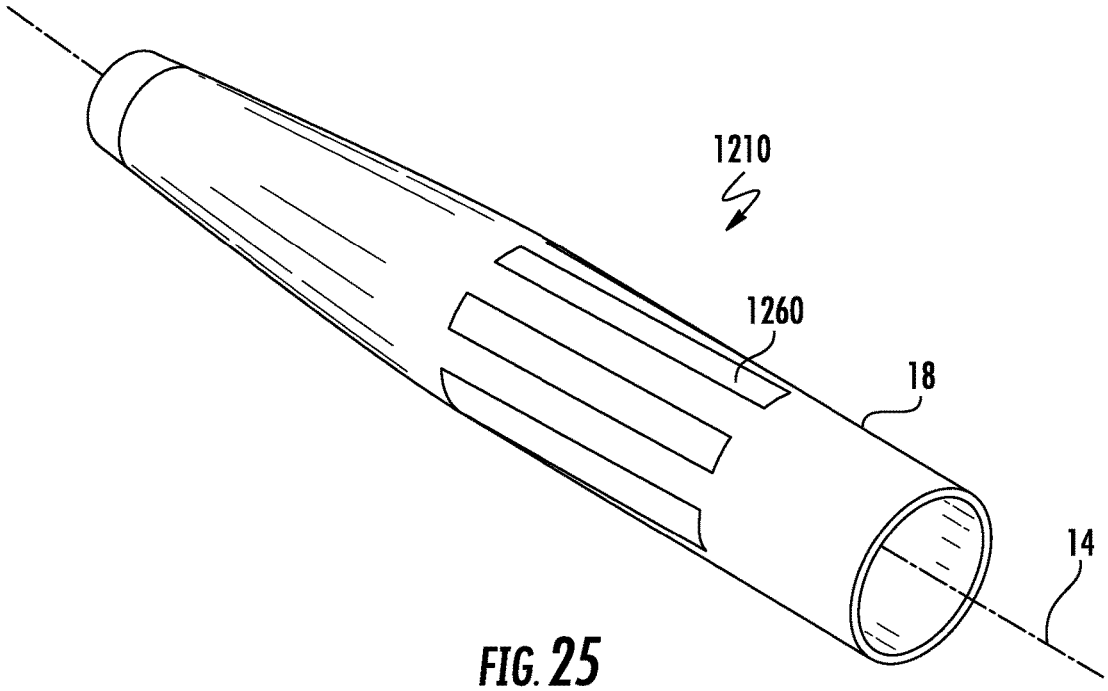
FIG. 25 is a perspective view of portions of an example ball bat.
Figure 26:
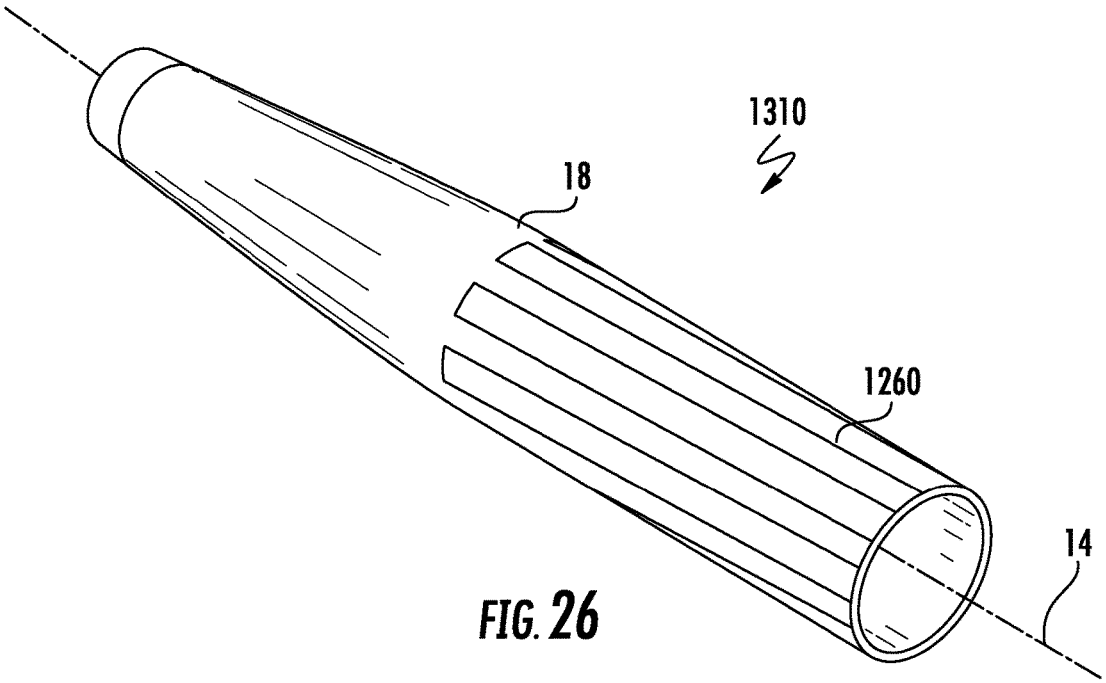
FIG. 26 is a perspective view of portions of an example ball bat.
Figure 27:
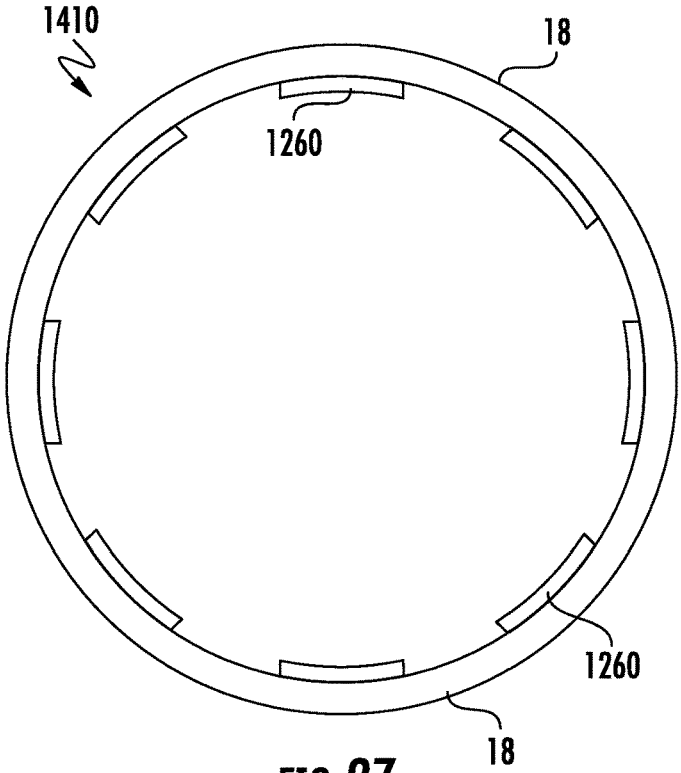
FIG. 27 is a cross-sectional view of an example ball bat.
Figure 28:
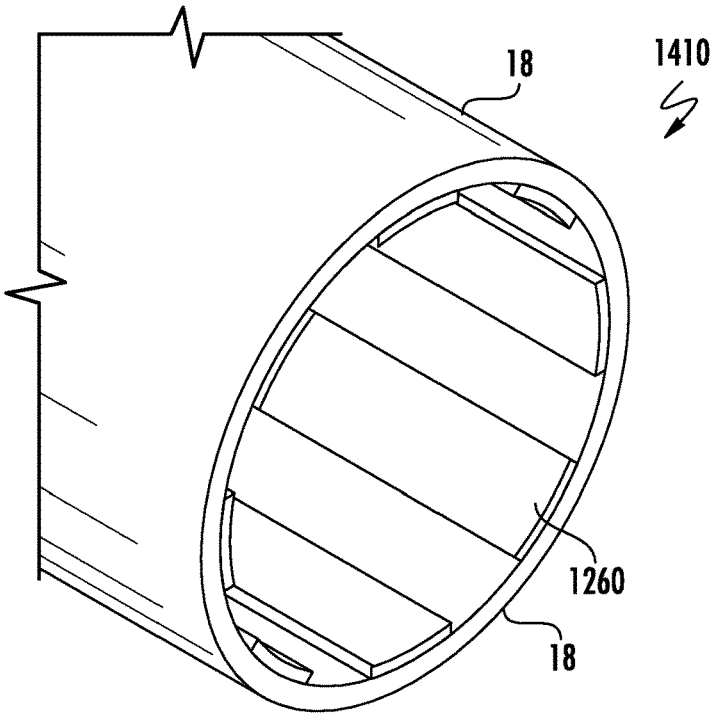
FIG. 28 is a perspective view of the ball bat of FIG. 27 with portions shown in section.

Table 13 and FIG. 24 illustrate the effect on spin rate of a ball impacting a stock DeMarini® Voodoo® baseball bat, and fourth, fifth and sixth prototype bats. The fourth, fifth and sixth prototype bats being the same as the DeMarini Voodoo stock bat except that grooves have been formed into the inner surface of the barrel portion of the prototype bats at 0 degrees, 3.8 degrees and 7.6 degrees from the longitudinal axis of the bat. The bats were then tested at an angle of 5 degrees from a horizontal plane. The results show that the spin rate of the 3.8 degree prototype bat is the highest followed by the 7.6 degree prototype bat. The 0 degree prototype bat has produces essentially the same spin rate as the stock bat. Therefore, the fourth prototype bat with 0 degree grooves has a negligible effect on the spin rate produced by the bat. However, bats formed with grooves at angles of 3.8 degrees and 7.6 degrees produce increased spin rates when the bat is positioned at a typical hitting position of at an angle of approximately 5 degrees from horizontal.

TABLE 13

| Launch Angle (deg) | Stock Ave Ball Spin-Fixed (rpm) | Stock Ave Ball Spin 5 deg-Fixed Handle (rpm) | 0 BB ave Ball Spin 5 deg-Fixed Handle (rpm) | 3.8 BB ave Ball Spin 5 deg-Fixed Handle (rpm) | 7.6 BB ave Ball Spin 5 deg-Fixed Handle (rpm) |
|---|---|---|---|---|---|
| 15 | 1113.9 | 1093.3 | 1205.2 | 1189.1 | 1281.19 |
| 17.5 | 1133.0 | 1271.5 | 1349.5 | 1556.8 | 1575.15 |
| 20 | 1425.6 | 1617.4 | 1464.1 | 1785.2 | 1735.23 |
| 22.5 | 1585.9 | 1803.6 | 1757.9 | 2147.3 | 1974.12 |
| 25 | 1791.2 | 1940.3 | 1957.1 | 2216.2 | 2035.98 |
| 27.5 | 1954.9 | 2056.5 | 2153.9 | 2413.3 | 2236.30 |
| 30 | 2240.7 | 2264.6 | 2332.4 | 2548.5 | 2329.85 |
| 32.5 | 2394.3 | 2516.7 | 2461.1 | 2671.0 | 2523.59 |
| 35 | 2708.2 | 2624.1 | 2629.2 | 2889.6 | 2739.32 |
| Slope | 81.07 | 76.04 | 74.43 | 79.58 | 67.53 |

Figure 17:
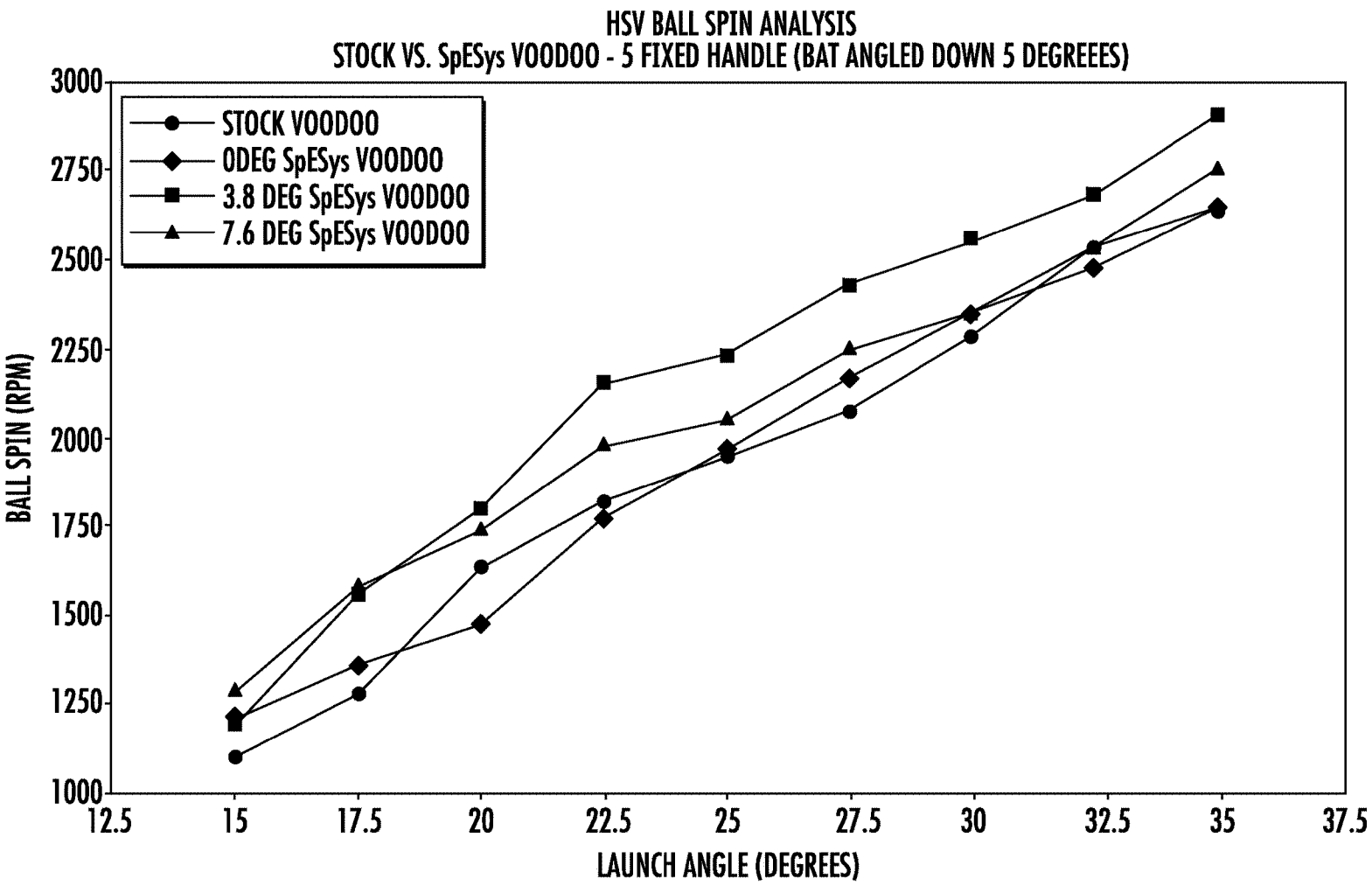
FIG. 17 is a graph of launch angle versus ball spin for different bats held at different angles and having launch angle booster grooves at different angles with respect to a longitudinal axis of the respective bat.

As demonstrated by FIGS. 16 and 17 and the above results, spin is enhanced most effectively for those grooves which extend along axis 14 at an angle that most closely approximates the downward angle of the bat, becoming more parallel to the ground. As demonstrated by FIG. 17, spin is not enhanced simply with the provision of grooves. As shown by FIG. 17, the same bats having grooves 140 angled from the longitudinal axis by 3.8° and 7.6° yielded effective spin enhancement over not only the same bat without any grooves but also with respect to the same bat having grooves that were not angled from the longitudinal axis (0°).

Figure 18:
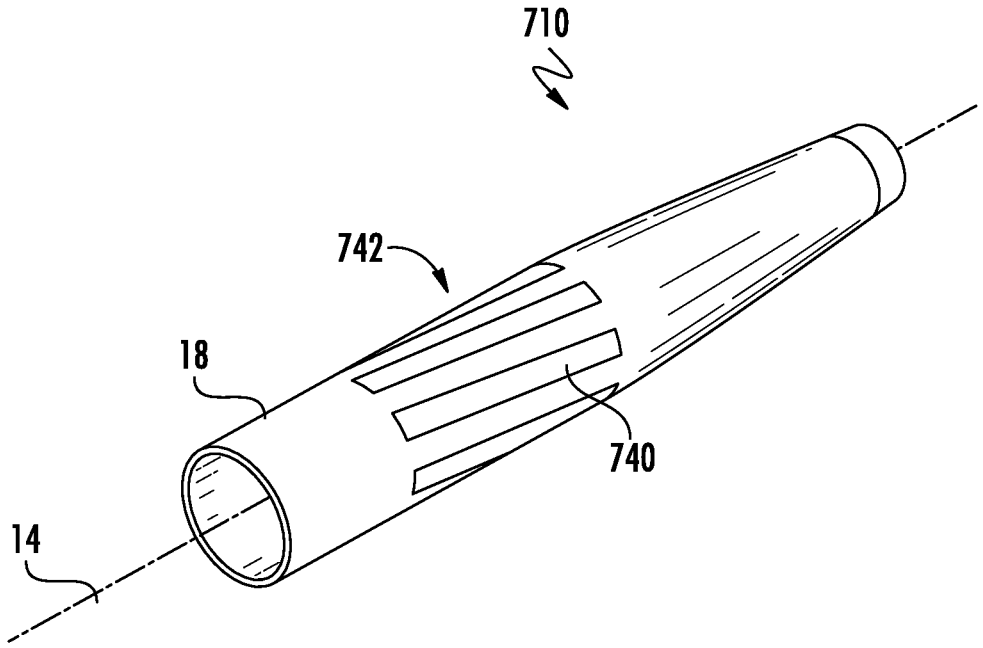
FIG. 18 is a perspective view of portions of an example ball bat.
Figure 19:
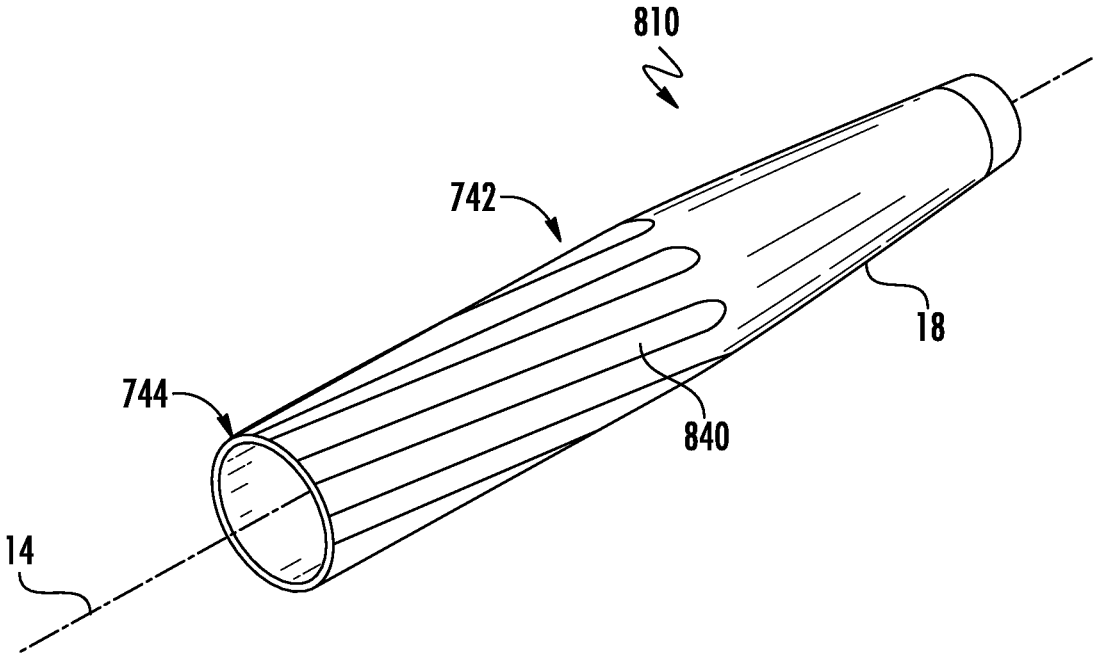
FIG. 19 is a perspective view of portions of an example ball bat.

Each of the launch angle boosters in the form of grooves, such as grooves 140, 340, 440 and 540 above are illustrated as extending along the inside surface of the generally hollow barrel portion 18. In other implementations, launch angle boosters may be provided on the exterior of the barrel portion 18. FIGS. 18 and 19 illustrate baseball bats 710 and 810, respectively, which comprise grooves 740 and 840 formed on the outer surface of the barrel portion 18 at angle of 5 degrees with respect to the longitudinal axis 14. In FIG. 18, the grooves 740 extend over a central region 742 of the barrel portion 18. In FIG. 19, the grooves 840 can extend over the central region 742 and a distal region 744 of the barrel portion 18. In other implementations, the length of the grooves can extend over the entire length of the barrel portion, or discrete portions thereof.

As with the formation of those grooves 140, 340, 440 and 540 which extend on the interior of barrel portion 18, grooves 740 and 840 may be formed on the exterior of barrel portion 18 through a chemical operation, a machining operation or a combination thereof after formation. In another implementation, the grooves 740, 840 may be formed on the exterior of the barrel portion using CNC mills or lathes, the grooves 740, 840 or flats can be cut on the outside of the barrel portion 18. Chemical etching may also be implemented with masking to cut away at the material in a controlled manner. In other implementations, the bat barrel portion 18 can be formed of a fiber composite material with grooves 740, 840.

Figure 20:
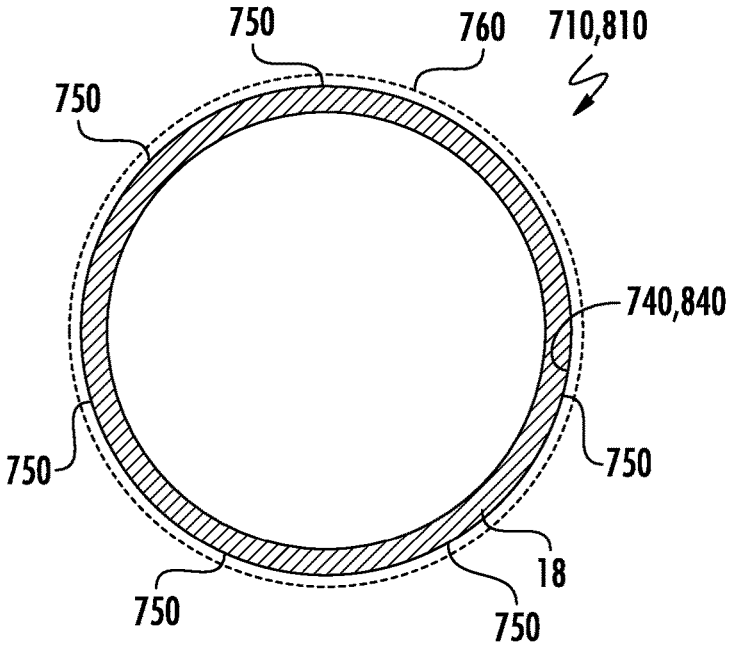
FIG. 20 is a cross-sectional view of the bats of FIGS. 18 and 19.

As shown by FIG. 20, in some implementations, the grooves 740, 840 can be formed and filled with filler 750 formed from a material such as, for example, specially designed silicone rubber strips or carefully laid out strips of composite to create flats on the external surface. In such an implementation, material 750 may provide baseball bats 710, 810 with a circumferential outer surface. In some implementations, filler 750 may comprise a composite strip molded over the aluminum or other material of barrel portion 18. As shown by broken lines, in some implementations, an additional outer layer or coating 760 may applied over the filler 750. In some implementations, the outer coating may not only cover fillers 750, but those portions of the outer surface between filler 750 subsequently encircle the barrel portion 18.

Figure 21:
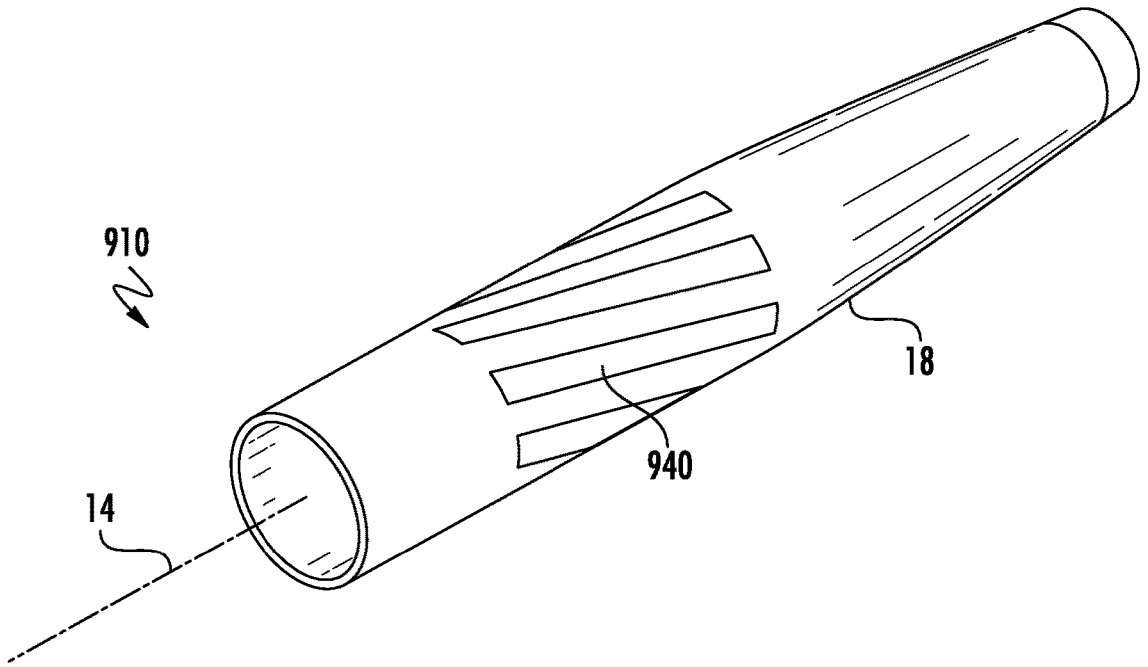
FIG. 21 is a perspective view of portions of an example ball bat.

FIG. 21 illustrates an example baseball bat 910. Bat 910 is similar to bat 710 except that bat 910 comprises launch angle boosters in the form of exterior grooves 940. Grooves 940 are similar to grooves 740. Grooves 940 are angled at 10° from the longitudinal axis 14. As with grooves 740 and 840, grooves 940 may be filled with fillers 750 and, in some implementations, coated with coating 760.

Figure 22:
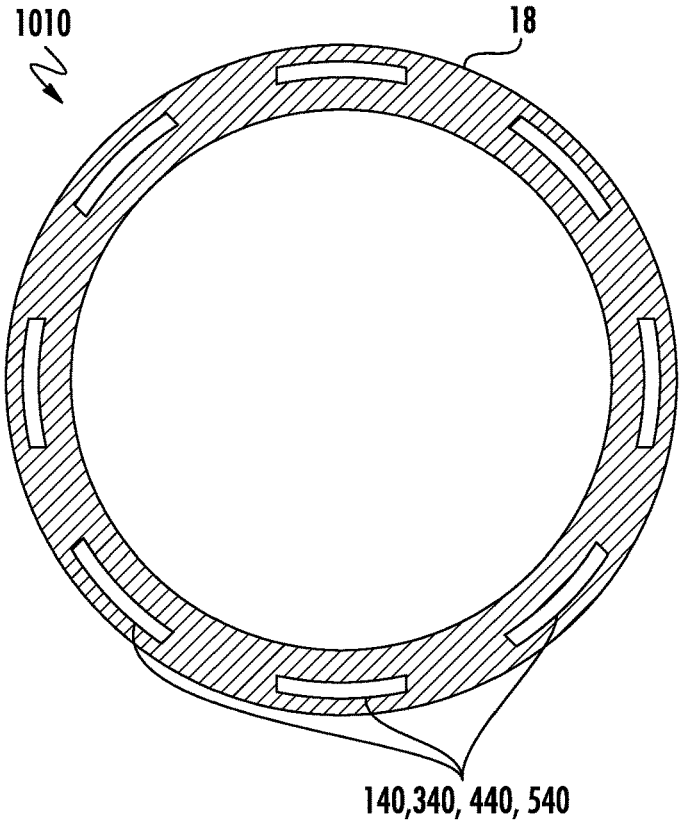
FIG. 22 is a cross-sectional view of an example ball bat.
Figure 23:
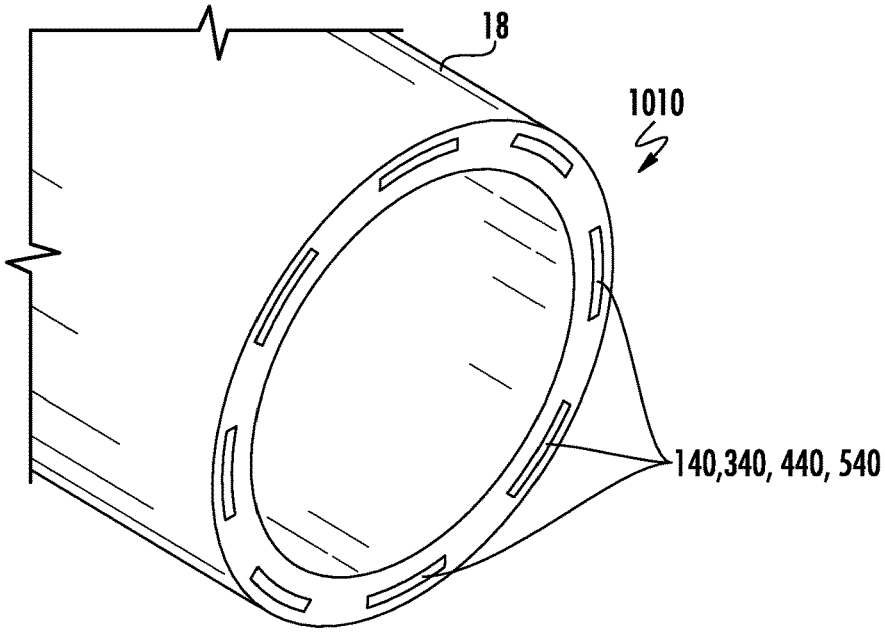
FIG. 23 is a perspective view of portions the example ball bat of FIG. 22, with portions shown in section.

FIGS. 22 and 23 illustrate portions of an example baseball bat 1010 having a barrel portion 18 that is formed with grooves or channels 140, 340, 440, 540 (described above) within the wall thickness of the barrel portion 18. Baseball bat 1110 is similar to baseball bat 10, wherein launch angle boosters comprise such grooves integrally formed within the wall of barrel portion 18. As shown by FIG. 22, such grooves are completely surrounded by the material of the wall of barrel portion 18 which is integrally formed as a single unitary body.

FIG. 24 illustrates an example baseball bat 1110. Baseball bat 1110 comprises other portions of bat 10 shown in FIG. 1. Baseball bat 1110 is similar to baseball bat 110 except that baseball bat 1110 additionally includes an insert 1150 positioned within the barrel portion 18. In one implementation, the insert 1150 is radially spaced from the floor of such grooves 140 by a distance or gap of at least 0.001 inches and no greater than 0.125 inches. In one implementation, the insert 1150 is radially spaced from the surface of the flats between grooves 140 by a distance or gap of at least 0.001 inches and no greater than 0.0625 inches. In other implementations, insert 1150 may have other spacings with respect to the wall of barrel portion 18.

FIGS. 25-28 illustrate various baseball bats 1210, 1310 and 1410 in which strips 1260 of fiber composite material can be applied to or formed to the barrel portion 18 to provide the varying wall thickness and related properties to the barrel portion 18. Bats 1210 and 1310 are similar to bat 10 described above except that bat 1210 and 1310 comprise launch angle boosters in the form of strips 1260 formed or applied to the exterior of barrel portion 18. Bat 1410 is similar to bat 10 described above except that bat 1410 comprises launch angle boosters in the form of strips 1260 formed or applied to the interior of barrel portion 18. As with launch angle boosters 40 and grooves 140, 340, 440, 540 and so on, strips 1260 extend along axis 14 at an angle of at least 3° and no greater than 12° from the longitudinal axis 14. In one implementation, just 1260 are angled at 50 from axis 14. In another implementation, strips 1260 are angled at 100 from axis 14.

Figure 29:
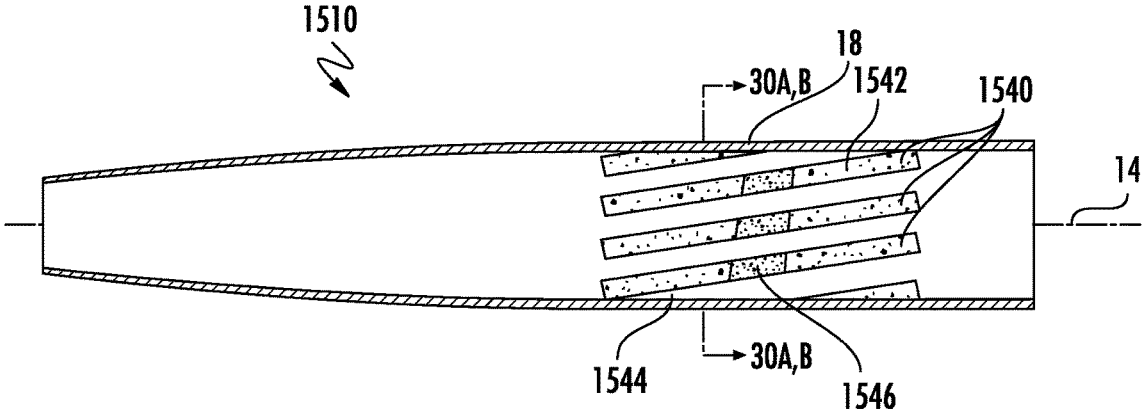
FIG. 29 is a sectional view of portions of an example ball bat.
Figure 30A:
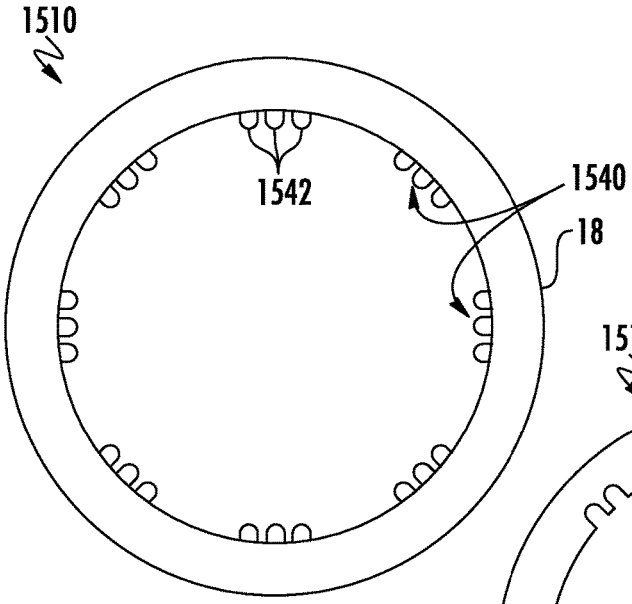
FIG. 30A is a cross-sectional view of the ball bat of FIG. 29 taken along line 30A-30A.

FIGS. 29 and 30A illustrate portions of an example ball bat 1510. Ball bat 1510 is similar to ball bat 10 described above except that ball bat 1510 comprises launch angle boosters in the form of rows 1540 of dense surface irregularities 1542, wherein the rows 1540 extend along the longitudinal axis 14 angled from the longitudinal axis 14 by at least 3° and no greater than 12°. In the example illustrated, the surface irregularities 1542 comprise bumps, protuberances or pimples on the inner surface of barrel portion 18. In other implementations, the surface irregularities 1542 may comprise dimples, stars, or other surface irregularities.

Figure 30B:
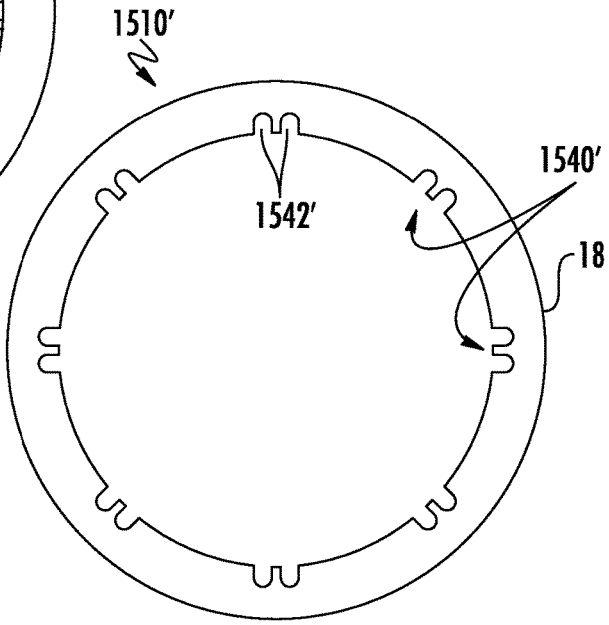
FIG. 30B is a cross-sectional view of an alternative example implementation of the ball bat of FIG. 29A.

FIG. 30B is a cross-sectional view illustrating ball bat 1510', an alternative example implementation of ball bat 1510. Ball bat 1510' is similar to ball bat 1510 except that ball bat 1510' comprises rows 1540' of surface alterations 1542' in place of surface alterations 1542. Surface alterations or irregularities 1542' comprise indentations, such as dimples, depressions or craters arranged in rows 1540', wherein the rows 1540' extend along the longitudinal axis 14 angled from the longitudinal axis by at least 3° and no greater than 12°.

As shown by FIG. 29, in some implementations, the density of the irregularities 1542 may vary along the rows, along longitudinal axis 14. For example, each of the rows 1540 may have a less dense region 1544 between which is a more dense region 1546 of irregularities. Such variation along each of rows 1540 may result in the launch angle boosters provided by rows 1540 having a varying property along longitudinal axis 14. The location of the dense region 1546 may be located based upon the "sweet spot" of barrel portion 18. For example, properties of the launch boosters provided by rows 1540 may vary along the length of axis 14 so as to provide greater launch angle enhancement selected portions of the longitudinal length of barrel portion 18 as compared to other portions of barrel portion 18.

Figure 31:
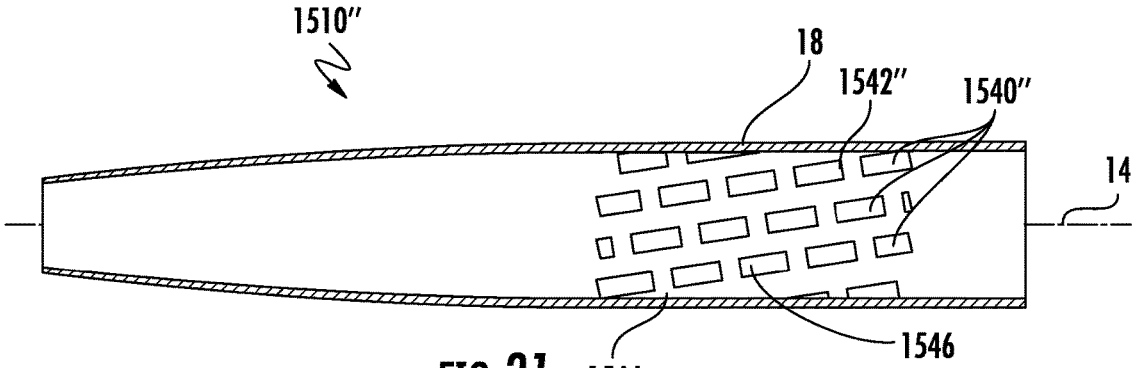
FIG. 31 is a sectional view of an example ball bat.
Figure 32:
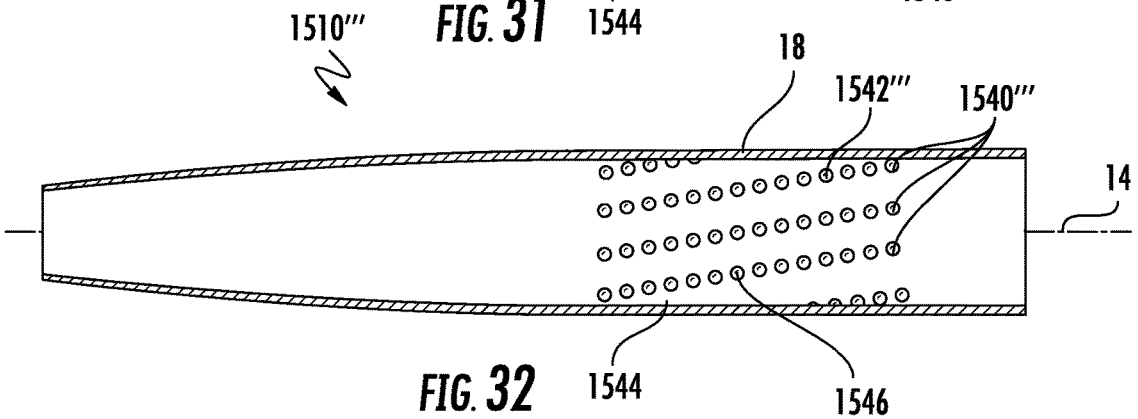
FIG. 32 is a sectional view of an example ball bat.

FIGS. 31 and 32 illustrate example bats 1510" and 1510'", alternative example implementations of bat 1510. Bat 1510" is similar to bat 1510 except that bat 1510" comprises surface irregularities 1542" in the form of short spaced apart grooves 1542" arranged in series to form rows 1540". Bat 1510'" is similar to bat 1510 except the bat 1510'" comprises surface irregularities 1542'" in the form of short spaced apart pebbles or craters (circular or oval indentations) generally arranged in series or in rows 1540'". The rows 1540" and 1540'" each extend along the longitudinal axis 14 angled from the longitudinal axis by at least 3° and no greater than 12°.

Figure 33:
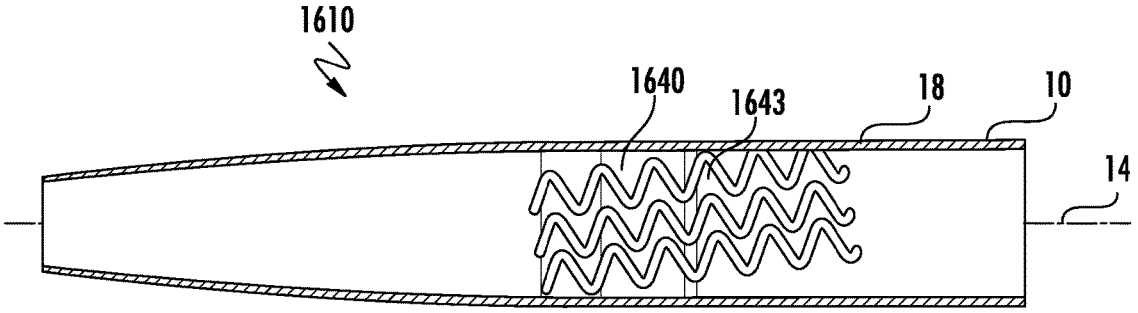
FIG. 33 is a sectional view of an example ball bat.
Figure 34:
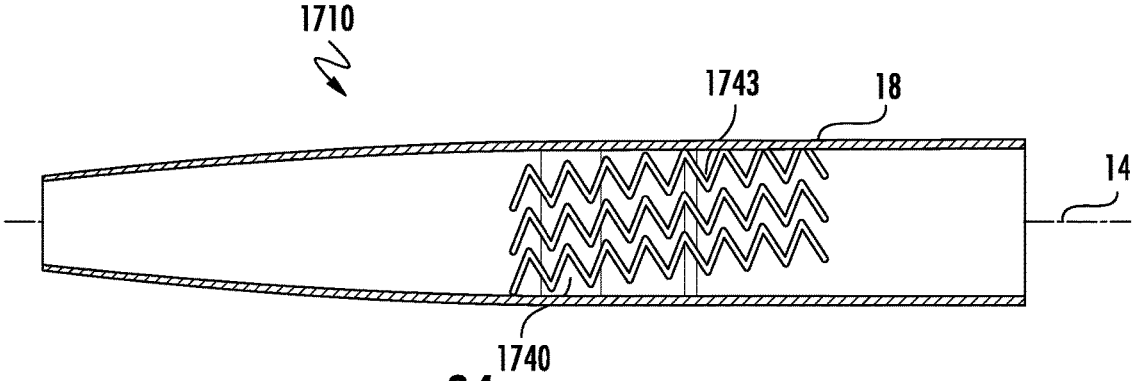
FIG. 34 is a sectional view of an example ball bat.

FIGS. 33 and 34 illustrate example bats 1610 and 1710, respectively. Bats 1610 and 1710 are similar to bat 10 described above except that bat 1610 and 1710 are illustrated as specifically comprising launch angle boosters 1640 and 1740, respectively. Launch angle boosters 1640 and 1740 generally extend along axes that are angled with respect to the centered longitudinal axis 14 of barrel portion 18. However, as illustrated by FIGS. 33 and 34, launch angle boosters 1640 and 1740 (schematically illustrated as a line) are not linear or are not parallel to the axis along which the individual launch angle 1640, 1740 extends. As shown by FIG. 33, launch angle boosters 1640 extend in a wavelike pattern or sinusoidal pattern generally centered along the axis 1643 which is angled from longitudinal axis 14 by at least 3° and no greater than 12°. As shown by FIG. 34, launch angle boosters 1640 are each formed of individual linear segments that crisscross their respective axis 1743 and form a pattern generally centered along axis 1743 along the length of axis 1743. Like axes 1643 along which boosters 1640 extend, axes 1743 along which boosters 1740 extend our angled from longitudinal axis 14 by at least 3° and no greater than 12°.

In each of the above implementations, launch angle boosters 40, 140, 340, 440, 540, 740, 840, and 940 are illustrated as being uniformly spaced about an inner circumference along the inner surface of portions of the barrel portion of a ball bat. As a result, the launch angle boosters provide enhanced exit velocity, launch angle and spin rate as well as an enhanced in-flight distance largely regardless of the angular positioning of the ball bat about its longitudinal axis during ball impact. In other words, the launch angle boosters consistently and reliably impact batted ball characteristics regardless of where or how the batter grips the bat, regardless of what portion of the outer circumferential face of the barrel portion of the bat faces the pitcher or an oncoming ball.

In other implementations, a baseball bat may be provided with asymmetric or discontinuous regions having the above-described launch angle boosters 40, 140, 340, 440, 540, 740, 840, and 940. In such implementations, markings, asymmetric shaped portions of the bat or other indicia may indicate the asymmetric location of the launch angle boosters, facilitating proper positioning of the region of the barrel portion of the bat having the launch angle boosters. For example, a batter may choose to use the launch angle boosters, using the indicia to identify where the boosters are located, by gripping the bat such that the regions containing the launch angle boosters face the pitcher or the oncoming ball. In some implementations, a batter may choose not to use the launch angle boosters, using the indicia identifying where the bushes are located, by gripping the bat such the regions omitting the launch angle boosters face the picture or the oncoming ball.

Figure 35:
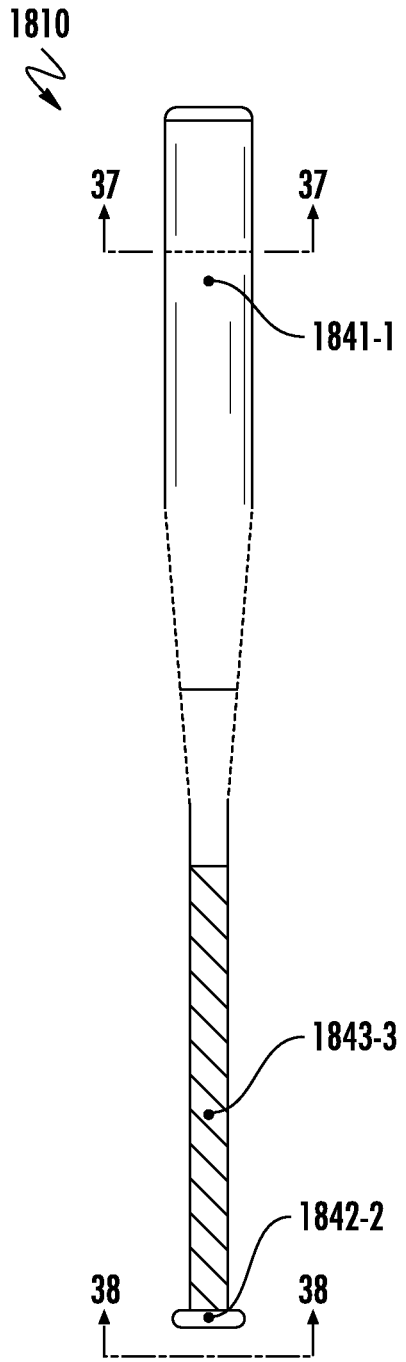
FIG. 35 is a side view of an example ball bat.
Figure 36:
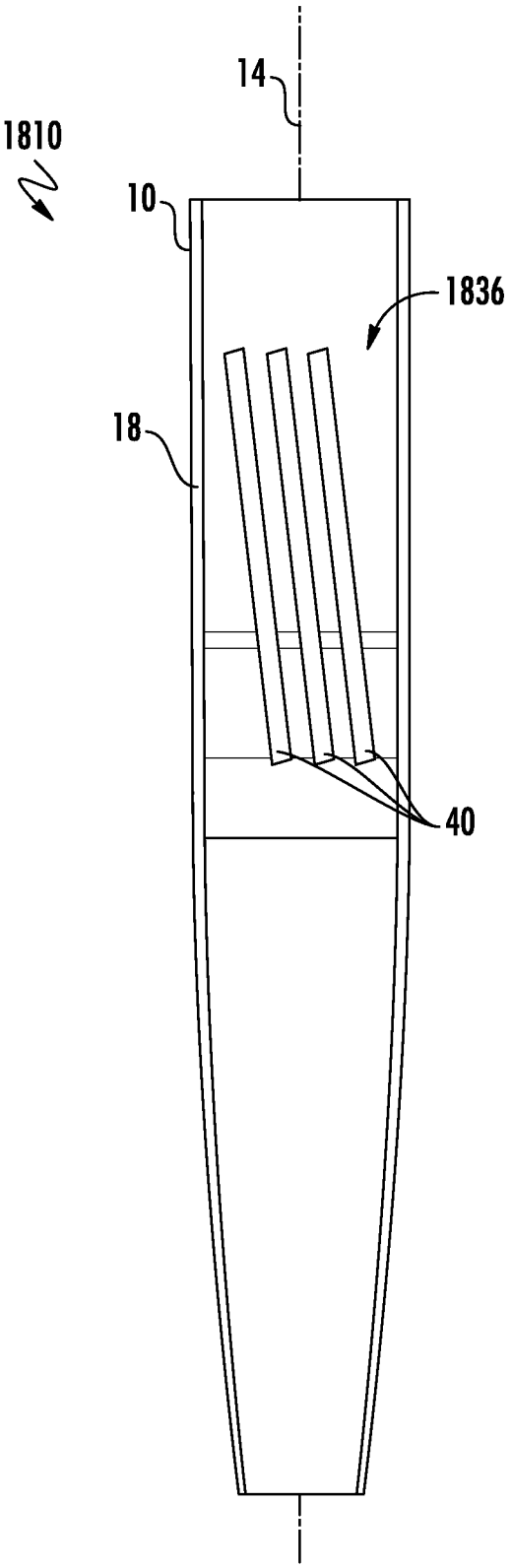
FIG. 36 is a sectional view of portions of the ball bat of FIG. 33.
Figure 37:
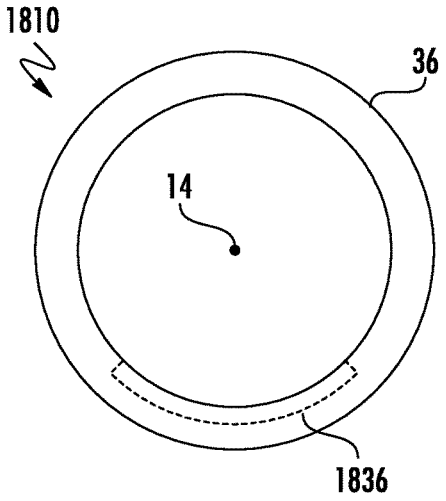
FIG. 37 is a cross-sectional view of portions of the ball bat of FIG. 35 taken along line 35-35.
Figure 38:
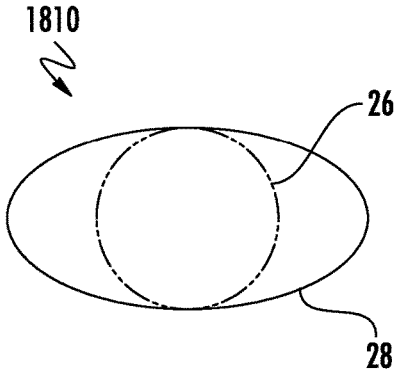
FIG. 38 is an end view of the ball bat of FIG. 37 taken along line 37-37.

FIGS. 35-37 illustrate an example ball bat 1810. FIG. 35 is a side view of ball bat 1810. FIG. 36 is a sectional view of ball bat 1810. FIG. 37 is a cross-sectional view taken along line 37-37 of FIG. 33. FIG. 38 is an end view taken along line 38-38 of FIG. 33.

Ball bat 1810 is similar to the ball bat 10 described above except that ball bat 1810 does not include launch angle boosters 40 that continuously and uniformly extend at circumferential spaced locations about an entire inner circumference of the barrel portion, for example, five launch angle boosters 40 having a centerline-to-centerline angular spacing of 360/5, 72°, 10 launch angle boosters 40 having a centerline to centerline angular spacing of 360/10, 36° or 20 launch angle boosters 40 having a centerline to centerline angular spacing of three and 60/20, 18°. In contrast, ball bat 1810 has a single region 1836 containing launch angle boosters 40. Region 1836 extends along one interior side of bat 1810. In the example illustrated, region 1810 extends approximately 90° about the axial centerline 14 of bat 1810. In other implementations, region 1836 may extend about centerline 14 by at least 30 degrees. In implementations where the launch angle does not circumscribe the entire circumference of the bat, region 1836 extends about centerline 14 by at least 30° and no greater than 90°. In other implementations, region 1836 may extend about centerline 14 by other extents. In these above described implementations, the launch angle boosters 40 can be described as a series of alternating elongate grooves within the barrel portion 18

Region 1810 contains launch angle boosters 40. It should be appreciated that such launch angle boosters 40 may comprise any of the above-described launch angle boosters. Region 1810 may comprise any number of launch angle boosters 40, 140, 340, 440, 540, 740, 840, and 940 having uniform or non-uniform angular spacings between the individual launch angle boosters of the set of launch angle boosters contained within the region 1810.

As further shown by FIG. 35, bat 1810 includes indicia 1842-1, 1842-2, 1842-3 (collectively referred to as indicia 1842) which visibly indicate to a batter the location of the region 1836 of launch angle boosters 40, 140, 340, 440, 540, 740, 840, or 940. The indicia 1842 comprise markings on external surfaces of the bat 1810. For example, indicia 1842-1 is located on the external surface of the barrel portion 36 of the bat. Indicia 1842-2 is located on external portion of the knob 28 of bat 1810. Indicia 1842-3 is located on the handle portion of the bat such that the indicia 1842-3 is concealed when the batter grips over top of the indicia 1842-3. In such a manner, the opposing team may not be notified of whether the particular batter is employing the launch angle boosters during a particular swing. Such indicia or markings may additionally or alternatively located at other external locations along the bat.

As further shown by FIG. 38 which illustrates bat 1810 from its knob end, portions of bat 1810 may be asymmetrically shaped or configured so as to further identify the location of region 1836. In the example illustrated, knob 28 of bat 1810 is eccentric are asymmetric with respect to axis 14, wherein the asymmetric shape identifies the interior location of region 1836 of launch angle boosters 40. In yet other implementations, portions of handle 26 or other portions of bat 1810 may be asymmetrically shaped so as to identify the interior location of region 1836. In other implementations, bat 1810 can include a symmetrical knob, such as knob 28 of FIG. 1.

Figure 39:
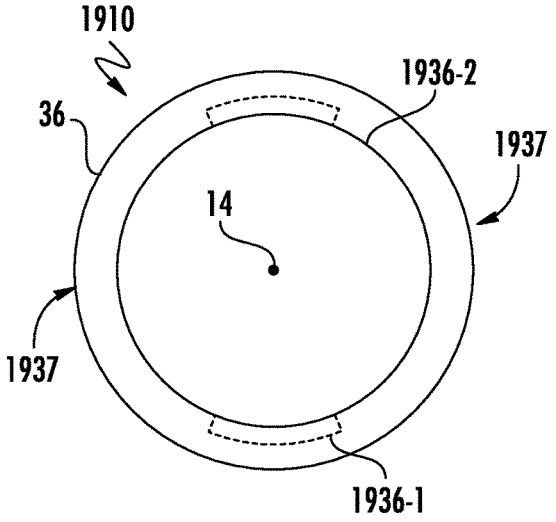
FIG. 39 is a cross-sectional view of portions of an example ball bat.

FIG. 39 is a cross sectional view taken along a line similar to line 35-35 through the barrel portion of an example ball bat 1910. Ball bat 1910 is similar to the ball bat 1810 described above except the ball bat 1910 comprises a plurality of angularly spaced regions 1936-1 and 1936-2 (collectively referred to as regions 1936). Each of regions 1936 is similar to region 1836 described above. Regions 1936 are angularly spaced such that barrel portion 36 of bat 1910 comprises circumferential regions 1937 that omit interior launch angle boosters. In the example illustrated, each of regions 1936 angularly extends about centerline 14 by 45° and is directly opposite to the other of regions 1936. Each of regions 1936 includes a similar set of launch angle boosters 40, 140, 340, 440, 540, 740, 840, or 940. As a result, the multiple sets 1936 may make it easier for a batter to appropriately grip that 1910 to appropriately locate (or not locate) one of regions 1936 for a swing.

Figure 40:
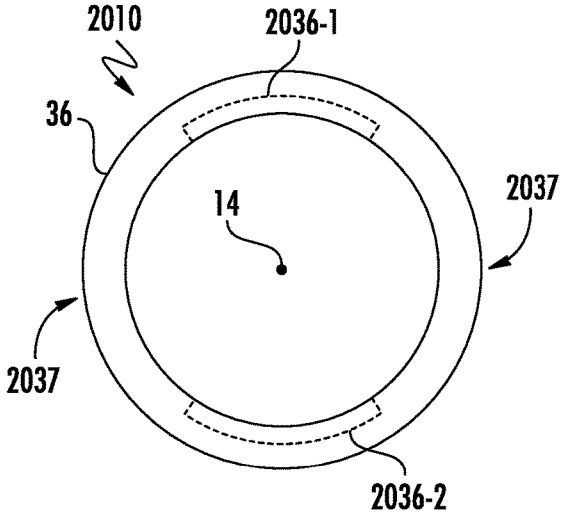
FIG. 40 is a cross-sectional view of portions of an example ball bat.

FIG. 40 is a cross sectional view taken along line similar to line 37-37 through a barrel portion of an example ball bat 2010. Ball bat 2010 is similar to ball bat 1810 described above except that bat 2010 comprises a pair of oppositely positioned regions 2036-1, 2036-2 (collectively referred to as regions 2036). Each of region 2036 comprises a set of launch angle boosters 40, 140, 340, 440, 540, 740, 840, or 940 and is spaced from the opposite region 2036 by regions 2037 that omit such launch angle boosters. Each of region 2036 angularly extends about the centerline 14 by 60°. Unlike regions 1936 which are contained similar sets of launch angle boosters, regions 2036 contain different sets of launch angle boosters having different characteristics. For example, region 2036-1 may have launch angle boosters in the form of grooves having a spacing, a width, a length, a density, a depth, an angular offset from centerline 14, a stiffness, whereas region 2036 may have launch angle boosters in the form of grooves which are different with respect to at least one of spacing, with, length, density, depth, angular offset or stiffness.

Ball bat 2010 provides a batter with the ability to customize or choose from amongst multiple different sets of launch angle boosters during a particular swing. For example, when encountering a first pitcher or when having a first hitting objective (objective of hitting a line drive, a fly ball, a hit to a certain part of the field or the like) during a first at-bat, the batter may choose, using at least one of indicia 1842 (shown and described with respect to FIGS. 35 and 38), to orient region 2036-1 for striking the oncoming ball. When encountering a second different pitcher or when having a second different hitting objective during a second at-bat, the batter may choose, using at least one of indicia 1842 (shown and described with respect to FIGS. 35 and 38), to orient region 2036-2 for striking the oncoming ball.

Although the present disclosure has been described with reference to example implementations, workers skilled in the art will recognize that changes may be made in form and detail without departing from the spirit and scope of the claimed subject matter. For example, although different example implementations may have been described as including features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A ball bat comprising:

one of a left-hand configuration designated for a left-handed batter and a right hand configuration designated for a right-handed batter, the left hand configuration being different than the right hand configuration; and one of a left-hand indicia indicating the left hand configuration and a right hand indicia indicating the right hand configuration, the bat extending along a longitudinal axis and including a handle portion coupled to a barrel portion, the barrel portion comprising circumferentially spaced launch angle boosters, and each of the launch angle boosters extending along the axis at an angle of at least 3° and no greater than 12° from the longitudinal axis.

2. The ball bat of claim 1, wherein the left-hand configuration comprises first launch angle boosters that are angled about a longitudinal axis of the ball bat in a first direction and wherein the right-hand configuration comprises second launch angle boosters are angled about the longitudinal axis in a second direction.

3. The ball bat of claim 1, wherein the left-hand indicia comprises a first color and wherein the right hand indicia comprises a second color different than the first color.

4. The ball bat of claim 1, wherein the left-hand indicia comprises a first surface treatment and where the right hand indicia comprises a second surface treatment different than the first surface treatment.

5. The ball bat of claim 1, wherein the left-hand indicia comprises a first shape and were in the right hand indicia comprises a second shape different than the first shape.

6. The ball bat of claim 1, wherein the barrel portion comprises a wall and wherein the launch angle boosters comprise barrel wall thickness variations.

7. The ball bat of claim 1, wherein the barrel portion comprises a wall and wherein the launch angle boosters comprise grooves on an interior surface of the wall.

8. The ball bat of claim 1, wherein the barrel portion comprises a wall and wherein the launch angle boosters comprise structures mounted to an interior surface of the wall.

9. The ball bat of claim 1, wherein the launch angle boosters are configured to enhance launch angle of a ball following bat impact.

10. The ball bat of claim 1, wherein the launch angle boosters are configured to enhance exit velocity of a ball at a given launch angle following bat impact.

11. The ball bat of claim 1, wherein the launch angle boosters are configured to enhance a spin of a ball following bat impact.

12. A ball bat for impacting a ball, the bat extending along a longitudinal axis and comprising:

a body including a handle portion and a barrel portion, the barrel portion including spin enhancing structure for facilitating a batter's ability to impart spin on to the ball, the spin enhancing structure including a plurality of grooves formed into the barrel portion of the bat, the grooves extending at angle within the range 3 to 12 degrees with respect to the longitudinal axis of the bat.

13. The ball bat of claim 12, wherein the spin enhancing structure includes a barrel wall thickness variation around a circumference of the ball bat.

14. The ball bat of claim 12, wherein the grooves comprise a groove having a characteristic that varies as it extends along the longitudinal axis.

15. The ball bat of claim 12, wherein each of the grooves comprises a first segment having a first dimension and a second segment having a second dimension corresponding to the first dimension, the second dimension being different than the first dimension.

16. The ball bat of claim 12, wherein the ball bat is designated for a right-handed batter and wherein each of the grooves extends from below the longitudinal axis to above longitudinal axis in a direction away from the handle portion when the longitudinal axis is horizontal.

17. The ball bat of claim 12, wherein the ball bat of the designated for a left-handed batter and wherein each of the grooves extends from above the longitudinal axis to below the longitudinal axis in a direction away from the handle portion when the longitudinal axis is horizontal.

* * * * *